US006166725A

United States Patent [19]

Isami et al.

[11] Patent Number: 6,166,725

[45] Date of Patent: Dec. 26, 2000

[54] LIQUID CRYSTAL DISPLAY DEVICE WHEREIN VOLTAGES HAVING OPPOSITE POLARITIES ARE APPLIED TO ADJACENT VIDEO SIGNAL LINES OF A LIQUID CRYSTAL DISPLAY PANEL

[75] Inventors: Hironobu Isami, Mobara; Hirobumi Koshi, Chousei-gun; Mitsuru Goto, Mobara; Yukihide Ode, Mobara; Hiroshi Watanabe, Mobara, all of Japan

[73] Assignees: Hitachi, Ltd., Tokyo; Hitachi Device Engineering Co., Ltd., Mobara, both of Japan

[21] Appl. No.: 09/450,436

[22] Filed: Nov. 30, 1999

Related U.S. Application Data

[63] Continuation of application No. 08/826,973, Apr. 9, 1997, Pat. No. 5,995,073.

[30] Foreign Application Priority Data

Apr. 9, 1996 [JP] Japan ..... 8-86668

[51] Int. Cl.[7] ..... G09G 3/36

[52] U.S. Cl. ..... 345/209; 345/96; 345/98; 345/100

[58] Field of Search ..... 345/87–100, 208, 345/209, 211

[56] References Cited

U.S. PATENT DOCUMENTS

| | | | |
|---|---|---|---|
| 4,746,197 | 5/1988 | Endo et al. | 345/87 |
| 5,229,761 | 7/1993 | Fuse | 345/99 |
| 5,274,366 | 12/1993 | Hayashi et al. | 345/103 |
| 5,376,944 | 12/1994 | Mogi et al. | 345/100 |
| 5,448,259 | 9/1995 | Hidaka | 345/98 |
| 5,523,772 | 6/1996 | Lee | 345/98 |
| 5,576,729 | 11/1996 | Yamazaki | 345/94 |
| 5,861,863 | 1/1999 | Kudo et al. | 345/100 |
| 5,880,706 | 3/1999 | Nakamura | 345/96 |
| 5,959,603 | 9/1999 | Ito et al. | 345/100 |

*Primary Examiner*—Bipin Shalwala
*Assistant Examiner*—David L. Lewis
*Attorney, Agent, or Firm*—Antonelli, Terry, Stout & Kraus, LLP

[57] ABSTRACT

A liquid crystal display device includes a video signal line drive circuit which includes (1) a first drive voltage circuit including at least one first output circuit which outputs an LC driving voltage of positive polarity corresponding to display data, and at least one second output circuit which outputs an LC driving voltage of negative polarity corresponding to display data, the at least one first output circuit and the at least one second output circuit being arranged alternately in a first polarity order, (2) a second drive voltage circuit including at least one third output circuit which outputs an LC driving voltage of positive polarity corresponding to display data, and at least one fourth output circuit which outputs an LC driving voltage of negative polarity corresponding to the display data, the at least one third output circuit and the at least one fourth output circuit being arranged alternately in a second polarity order opposite to the first polarity order, (3) a first switching circuit which inputs display data to the first voltage drive circuit and the second voltage drive circuit in two different input orders which are alternated, and (4) a second switching circuit which supplies outputs from the first drive voltage circuit and the second drive voltage circuit to video signal lines of a liquid crystal display panel in two different output arrangements which are alternated in synchronism with the alternation of the two different input orders.

1 Claim, 20 Drawing Sheets

LIQUID CRYSTAL DISPLAY DEVICE WHEREIN VOLTAGES HAVING OPPOSITE POLARITIES ARE APPLIED TO ADJACENT VIDEO SIGNAL LINES OF A LIQUID CRYSTAL DISPLAY PANEL

CROSS-REFERENCE TO RELATED APPLICATION

This application is a continuation of application Ser. No. 08/826,973 filed on Apr. 9, 1997, now U.S. Pat. No. 5,995,073.

BACKGROUND OF THE INVENTION

The present invention relates to a method of driving a liquid crystal display device for use in a personal computer, a work station or the like, and more specifically to a technology effective for application to a video signal line driver of a liquid crystal display device to enable a multi-gray scale display.

Liquid crystal display devices of the prior art are broadly classified into a simple matrix type liquid crystal display device wherein a pixel at an intersection of X and Y stripe electrodes is driven, and an active matrix type liquid crystal display device wherein a pixel is driven by switching an active element (for example, a thin film transistor) provided at each pixel.

An active matrix type liquid crystal display device has an advantage that, since a liquid crystal (hereinafter LC) driving voltage (gray scale voltage) is applied to a pixel electrode via an active element, for example, a thin film transistor (TFT), no crosstalk occurs between pixels and this eliminates the need for a special driving scheme to prevent crosstalk as required in the case of a simple matrix type liquid crystal display device and provides a multi-gray scale display.

Display methods of the active matrix type liquid crystal display device are broadly classified into the following two types.

One of the two types produces a display by driving an LC layer sandwiched between a pair of substrates each having transparent electrodes on its inner surface with an electric field generated by an LC driving voltage applied between the opposing transparent electrodes of the substrates and substantially perpendicular to the substrates, and modulating the amount of light passing through the LC layer after passing through one of the opposing transparent electrodes, and this type is hereinafter referred to as a vertical electric field type.

The other produces a display by driving an LC layer sandwiched between a pair of substrates with an electric field generated by an LC driving voltage applied between two electrodes on the same substrate or the two substrates and substantially parallel with the surfaces of the substrates, and modulating the amount of light passing through the LC layer after passing through the space between the two electrodes, and this type is hereinafter referred to as in-plane switching type.

FIG. 13 is a block diagram showing a schematic configuration of an active matrix type liquid crystal display module which is an active matrix type liquid crystal display device of the conventional vertical electric field type.

In FIG. 13, a liquid crystal display panel (TFT-LCD) is a liquid crystal display panel of the color TFT (Thin Film Transistor) type and has 640×3×480 pixels.

A drain driver (video signal line driver) 530 is disposed at the top of the liquid crystal display panel (TFT-LCD), and all of the video signal lines (drain signal lines or vertical signal lines) (DL) of the liquid crystal display panel (TFT-LCD) are connected to the drain driver 530.

Also a gate driver (vertical scanning circuit) 540 and an interface circuit 500 are disposed at the sides of the liquid crystal display panel (TFT-LCD), and each scanning signal line (gate signal line or horizontal signal line) (GL) of the liquid crystal display panel (TFT-LCD) is connected to the gate driver 540.

FIG. 14 is a diagram showing an equivalent circuit of the liquid crystal display panel (TFT-LCD) shown in FIG. 13.

FIG. 14 is a circuit diagram, and is illustrated corresponding to the actual geometric arrangement, and in FIG. 14, AR designates a display matrix area.

Each pixel of the liquid crystal display panel (TFT-LCD) is disposed within a region enclosed by two adjacent scanning signal lines (GL) and two adjacent video signal lines (DL), and includes two thin-film transistors (TFT1, TFT2), a pixel electrode (ITO1) and an additional storage capacitor (Cadd).

All drain electrodes of TFTs (TFT1's and TFT2's) associated with pixels in each column among pixels arranged in a matrix are connected to a corresponding video signal line (DL), which in turn is connected to a drain driver 530 for supplying an LC driving voltage (gray scale voltage) to a pixel electrode (ITO1) to drive the LC layer.

All gate electrodes (GT) of TFTs (TFT1's and TFT2's) associated with pixels in each row among pixels arranged in a matrix are connected with a corresponding scanning signal line (DL), which in turn is connected to a gate driver 540 for supplying a positive or negative bias voltage to the gate electrodes of the TFTs (TFT1's and TFT2's) during a horizontal scan period.

Source electrodes of thin film transistors (TFT1, TFT2) of a pixel are connected to a pixel electrode (ITO1), and an LC layer between the pixel electrode (ITO1) and a common electrode (ITO2) produces a capacity (CLC) connected to the pixel electrode (ITO1).

Each of the thin film transistors (TFT1, TFT2) becomes conducting when a positive bias voltage is applied to the gate electrode, and it becomes non-conducting when a negative bias voltage is applied to the gate electrode.

Also an additional storage capacitor (Cadd) is connected between each pixel electrode (ITO1) and a capacitor signal line (Cn).

As known well, the additional storage capacitor (Cadd) acts to reduce influence of the potential change of the gate electrode (GT) on the pixel electrode (ITO1) when each of the thin film transistors (TFT1, TFT2) performs switching.

The additional storage capacitor (Cadd) acts also to increase the time constant of discharge, and stores the video information for a long time after each of the thin film transistors (TFT1, TFT2) is turned off.

In addition, the capacitor signal line (Cn) may be shared by a scanning signal line (GL) immediately above the scanning line associated with the pixel under consideration.

An interface circuit 500 shown in FIG. 13 comprises a display control circuit 510 and a power supply circuit 520, and is formed as one driver circuit board (interface board).

The display control circuit 510 is formed as one semiconductor integrated circuit (LSI), and controls and drives a drain driver 530 and a gate driver 540 based on control signals such as a clock signal, a display timing signal, a horizontal sync signal, and a vertical sync signal and a display signal transmitted from the main computer.

If a display timing signal is inputted, the display control circuit 510 judges this as a display start position, and outputs a row of the received display data through a bus line 533 of the display data to the drain driver 530.

Then the display control circuit 510 outputs a display data latch clock (D2) which serves as a display control signal for latching display data, through a signal line 531 to a data latch circuit of the drain driver 530.

In this case, the display data from the main computer are transferred in pixel units comprising a triad of data for red (R), green (G) and blue (B) per unit time. Each display data is comprised of 18 bits, six bits per color.

Further, a carry output from the drain driver 530 in one stage is inputted as a carry input to the drain driver 530 in the next stage, and latching operation of the data latch circuit of the drain driver 530 is controlled by the carry signal to prevent wrong display data from being written into the data latch circuit.

When inputting of the display timing signal is finished or when a predetermined time has elapsed after the display timing signal is inputted, the display control circuit 510 determines that the display data corresponding to a horizontal scanning line have been inputted, and outputs an output timing control clock (D1) which serves as a display control signal for outputting the display data stored in the latch circuit of the drain driver 530 to a video signal line (DL) of a liquid crystal display panel (TFT-LCD), to the drain driver 530 through a signal line 532.

When the first display timing signal is inputted after the vertical sync signal is inputted, the display control circuit 510 judges this as the first display line and outputs a frame start indicating signal through a signal line 542 to the gate driver 540.

Further, the display control circuit 510 outputs a shift clock (G) of a horizontal scanning period through a signal line 541 to the gate driver 540 based on the horizontal sync signal so that a positive bias voltage is applied to each scanning signal line (GL) of the liquid crystal display panel (TFT-LCD) in sequence per horizontal scanning period.

Thereby a plurality of thin film transistors (TFT1, TFT2) connected to each scanning signal line (GL) of the liquid crystal display panel (TFT-LCD) become conducting during a horizontal scanning period.

The power supply circuit 520 comprises a voltage generating circuit 523 and a gate voltage generating circuit 524, and the gate voltage generating circuit 524 generates drive voltages (positive and negative bias voltages) to be applied to gates of the thin film transistors (TFT1, TFT2).

The voltage generating circuit 523 is comprised of a voltage divider formed of resistors connected in series, and generates nine gray scale reference voltages (V0–V8).

FIG. 15 is an exploded perspective view showing components of the active matrix type liquid crystal display module shown in FIG. 13.

In FIG. 15, SHD designates a frame-shaped shield case (metal frame) made of sheet metal, LCW designates a display window of the shield case (SHD), SPB designates a light diffuser, LCB designates a light guide, RM designates a reflector, BL designates a backlighting fluorescent lamp, and LCA designates a backlight case.

Driver circuit boards (PCB1, PCB2) are mounted around the liquid crystal display panel (TFT-LCD).

The driver circuit boards (PCB1, PCB2) are disposed along the periphery of the liquid crystal display panel, and the individual driver circuit boards (PCB1, PCB2) are electrically connected to other circuits by flat cables (not shown).

The driver circuit board (PCB1) has electronic parts thereon such as tape carrier packages (TCP), capacitors or the like, and is divided into the drain driver 530 portion and the gate driver 540 portion.

The driver circuit board (PCB2) has electronic parts thereon, such as semiconductor integrated circuits (IC), capacitors, resistors or the like, and the driver circuit board (PCB2) constitutes an interface circuit shown in FIG. 13.

The shield case (SHD), the liquid crystal display panel (TFT-LCD) with the driver circuit boards (PCB1, PCB2) mounted on its periphery , the light diffuser (SPB), the light guide (LCB), the reflector (RM), the backlighting fluorescent lamp (BL) and the backlight case (LCA) are stacked in the arrangement relation shown in FIG. 15 to form the active matrix type liquid crystal display module.

The active matrix type liquid crystal module is assembled as a unit by clamping its parts with claws and hooks provided in the shield case (SHD).

The backlight case (LCA) is configured to house the backlighting fluorescent lamp (BL), the light diffuser (SPB), the light guide (LCB) and the reflector (RM). Light from the backlighting fluorescent lamp (BL) disposed at the side of the light guide (LCB) is made uniform on the display screen by the light guide (LCB), the reflector (RM) and the light diffuser (SPB) and then is projected toward the liquid crystal display panel (TFT-LCB).

An inverter circuit board (PCB3) is connected to the backlighting fluorescent lamp (BL) and serves as a power source of the backlighting fluorescent lamp (BL).

The illuminating light from the backlighting fluorescent lamp (BL) passes through a polarizer on the backlight side, the liquid crystal layer (LC) filled and sealed between a pair of glass substrates and the front polarizer, and then exits from the liquid crystal display panel (TFT-LCD).

An area of the display window (LCW) of the shield case (SHD) defines a display area of the active matrix type liquid crystal display module, and a region other than the display area of the active matrix type liquid crystal display module, that is, a peripheral region around the display window of the shield case (SHD) is usually called a frame border area.

As shown in FIG. 16, the liquid crystal layer (LC) changes light transmission according to the strength of an electric field across the LC layer perpendicular to the upper and lower glass substrates.

A multi-gray scale image can be produced on the LC display panel by varying a voltage applied between a common electrode (ITO2) on one of a pair of glass substrates and a pixel electrode (ITO1) on the other of the pair, specifically, by applying to a pixel electrode (ITO1) an LC driving voltage corresponding to one of a plurality of gray scale levels with respect to a voltage applied to the common electrode (ITO2), consequently by modulating the amount of light passing through the LC layer from the backlighting fluorescent lamp and changing the amount of light passing through the front polarizer.

In general, when a voltage of the same polarity (DC voltage) is left applied across the LC for a long time, inclination of liquid crystal molecules in the liquid crystal layer (LC) becomes fixed. As a result, image retention occurs and shortens the lifetime of the LC.

In order to prevent this, in a conventional liquid crystal display device, the polarity of the LC driving voltage applied across the LC layer is reversed periodically. Specifically, the LC driving voltage applied to the pixel electrode is changed from positive to negative, and vice versa, every period with respect to the LC driving voltage applied to the common electrode.

For applying alternating voltages across the LC layer, two methods, a fixed common-electrode voltage method and a common-electrode voltage inversion method, are known as shown in FIGS. 17A and 17B, respectively.

The common-electrode voltage inversion method reverses both voltages applied to the common electrode and the pixel electrode, respectively, and the fixed common-electrode voltage method reverses the polarity of the voltage applied to the pixel electrode with respect to the fixed common voltage periodically. electrode.

The fixed common-electrode voltage method has disadvantages that an amplitude of a voltage applied to the pixel electrode is twice that of the common-electrode voltage inversion method and a low voltage driver cannot be used in this method, but has advantages that a dot-inversion drive method or a column-inversion drive method (See SID 91 DIGEST pp. 551–554 for further details) provides power consumption saving and an excellent quality display.

The active matrix type liquid crystal display module shown in FIG. 13 employs the dot-inversion drive method.

FIG. 18 is a diagram showing a relationship between the LC driving voltage outputted from the drain driver 530 to the video signal line (DL) shown in FIG. 13, i.e., the LC driving voltage applied to the pixel electrode (ITO1) and the LC driving voltage applied to the common electrode (ITO2).

In FIG. 18, the LC driving voltage outputted from the drain driver 530 to the video signal line (DL) is illustrated as displaying black on a white background of the liquid crystal display panel(TFT-LCD).

As shown in FIG. 18, the LC driving voltage (VDH) outputted from the drain driver 530 to the odd-numbered video signal line (DL) and the LC driving voltage (VDL) outputted from the drain driver 530 to the even-numbered video signal line (DL) are opposite in polarity with respect to the LC driving voltage (VCOM) applied to the common electrode (ITO2). That is, if the LC driving voltage (VDH) outputted to the odd-numbered video signal line (DL) is positive (or negative) in polarity, the LC driving voltage (VDL) outputted to the even-numbered video signal line (DL) is negative (positive) in polarity.

The polarity is inverted every line, and further, the polarity of every line is inverted every frame.

By using the dot-inversion drive method, since voltages applied to the adjacent signal lines (DL) are opposite from each other in polarity, currents flowing through the common electrode (ITO2) or the gate electrode (GT) cancel out each other and the power consumption can be reduced.

Also since a current flowing through the common electrode (ITO2) is small resulting in a small voltage, the voltage level of the common electrode (ITO2) is stable and deterioration of the display quality can be minimized.

FIG. 19 is a block diagram showing a schematic configuration of the drain driver 530 shown in FIG. 13.

As shown in FIG. 19, the drain driver 530 has a gray scale voltage generating circuit 551, which generates 64 levels of gray scale voltages based on nine gray scale reference voltages (V0–V8) inputted from the voltage generating circuit 523 and outputs the gray scale voltages through a voltage bus line 558 to an output circuit 557.

A shift register 553 within a control circuit 552 of the drain driver 530 generates a data input control signal for an input register 554 based on the display data latch clock (D2) inputted from the display control circuit 510 and outputs the data input control signal to an input register 554.

The input register 554 latches display data of six bits per color corresponding to its output signals in number, in synchronization with the display data latch clock (D2) inputted from the display control circuit 510 based on the data input control signal outputted from the shift register 553.

A storage register 555 latches display data in the input register 554 in response to the output timing control clock (D1) from the display control circuit 510 (FIG. 13).

The display data inputted to the storage register 555 are inputted through a level shifter circuit (1) 556 to an output circuit 557.

A control signal for AC driving to the drain driver 530 is used to control the polarity of a voltage outputted to the video signal line (DL).

FIG. 20 is a block diagram explaining a configuration of the drain driver 530, centering on a configuration of the output circuit 557 shown in FIG. 19.

The output circuit 557 shown in FIG. 19 is comprised of a decoder circuit (1) 561, an amplifier circuit pair 563, a switching circuit (1) 562 for switching between inputs of the amplifier circuit pair 563 and a switching circuit (2) 564 for switching between outputs of the amplifier circuit pair 563.

Reference characters Y1, Y2, Y3 and Y4 designate first, second, third and fourth video signal lines respectively, and a data latch circuit 565 indicates the input register 554 and the storage register 555 shown in FIG. 19.

A decoder circuit (1) 561 is comprised of a decoder circuit 577 for selecting a gray scale voltage corresponding to the display data outputted from each data latch circuit 565 (specifically the storage register 555 shown in FIG. 19), among 64 levels of gray scale voltages outputted from the gray scale voltage generating circuit 551 through the voltage bus lines 558 shown in FIG. 19.

The decoder circuit 577 is provided for each data latch circuit 565, and is a complementary decoder circuit formed of PMOS and NMOS transistors.

An amplifier circuit pair 563 is provided for each pair of adjacent decoder circuits 577, and is formed of a high-voltage inverting amplifier 571 and a low-voltage rail-to-rail amplifier 572.

The high-voltage inverting amplifier 571 outputs an LC drive voltage of positive polarity, and the low-voltage rail-to-rail amplifier 572 outputs an LC drive voltage of negative polarity.

The switching circuit (1) 562 inputs two gray scale voltages outputted from two decoder circuits 577 corresponding to two adjacent video signal lines (DL), for example, the two decoder circuits 577 corresponding to the first video signal line Y1 and the second video signal line Y2, respectively, to the high-voltage inverting amplifier 571 and the low-voltage rail-to-rail amplifier 572 of the amplifier circuit pair 563, respectively and alternately.

The switching circuit (2) 564 supplies two output voltages outputted from the high-voltage inverting amplifier 571 and the low-voltage rail-to-rail amplifier 572 of the amplifier circuit pair 563 to a proper one of two adjacent video signal lines (DL), for example, the first video signal line Y1 and the second video signal line Y2, respectively, in synchronization with the switching circuit (1) 562.

Here, the switching circuit (1) 562 and the switching circuit (2) 564 are controlled based on the control signal (M) for AC driving.

With the dot-inversion drive method, two voltages applied to adjacent signal lines (DL), for example, the first video signal line Y1 and the second video signal line Y2 ,or the third video signal line Y3 and the fourth video signal line Y4, are opposite in polarity.

In the output circuit 577 shown in FIG. 19, the switching circuit (1) 562 inputs two gray scale voltages outputted from decoder circuits (1) 561 corresponding to two adjacent video signal lines as shown in FIG. 20, for example, the first video signal line Y1 and the second video signal line Y2, to the high-voltage inverting amplifier 571 and the low-voltage rail-to-rail amplifier 572, respectively and alternately. The switching circuit (2) 564 supplies the two output voltages outputted from the high-voltage inverting amplifier 571 and the low-voltage rail-to-rail amplifier 572 to a proper one of the two adjacent video signal lines (DL), for example, the first video signal line Y1 and the second video signal line Y2, respectively in synchronization with the switching circuit (1) 562.

That is, the control signal (M) for AC driving switches between the following state 1 and state 2.

State 1

Decoder circuit 577 output corresponding to signal line Y1→High-voltage inverting amplifier→Signal line Y1
Decoder circuit 577 output corresponding to signal line Y2→Low-voltage rail-to-rail amplifier→Signal line Y2

State 2

Decoder circuit 577 output corresponding to signal line Y1→Low-voltage rail-to-rail amplifier→Signal line Y1
Decoder circuit 577 output corresponding to signal line Y2→High-voltage inverting amplifier→Signal line Y2

When the drain driver 530 shown in FIG. 20 is employed, a pair of the high-voltage inverting amplifier 571 and the low-voltage rail-to-rail amplifier 572 need not be provided for each video signal line (DL), a chip area of a semiconductor integrated circuit (IC chip) constituting the drain driver 530 may be reduced in comparison with an IC wherein a pair of the high-voltage inverting amplifier 571 and the low-voltage rail-to-rail amplifier 572 are provided for each video signal line (DL).

FIG. 21 is a circuit diagram showing a circuit configuration of the decoder circuit 577 shown in FIG. 20.

The decoder circuit 577 has 64 transistor rows (TRP1), each row comprising six low-voltage PMOS transistors connected in series on one side of an output terminal and six low-voltage NMOS transistors connected in series on the other side of the output terminal.

64 levels of gray scale voltages outputted from the gray scale voltage generating circuit 551 through the voltage bus lines 558 shown in FIG. 19 are applied between ends of the 64 transistor rows (TRP1), respectively.

A predetermined combination of non-inverted (T) and inverted (B) outputs of each bit of six bits for display data are outputted from the level shift circuit (1) 556 and applied selectively to each of the gate electrodes of the six PMOS transistors and the six NMOS transistors of each transistor row (TRP1).

FIG. 22 is a circuit diagram showing a circuit configuration of the switching circuit (1) 562, the amplifier circuit pair 563 and the switching circuit (2) 564 shown in FIG. 20.

In FIG. 22, switching circuits (IN1, IN2) indicate the switching circuit (1) 562 in FIG. 20, and switching circuits (OUT1, OUT2) indicate the switching circuit (2) 564 in FIG. 20.

Here, the switching circuits (IN1, IN2) are formed of complementary MOS transistors comprising PMOS and NMOS transistors connected in parallel.

The low-voltage rail-to-rail amplifier 572 constituting the amplifier circuit pair 563 is a voltage follower wherein an inverting terminal and an output terminal of an operational amplifier (OP1) are directly connected, and a non-inverting terminal is made as an input terminal.

The high-voltage inverting amplifier 571 constituting the amplifier circuit pair 563 is an inverting amplifier comprising an operational amplifier (OP2), and a switching circuit (SW1) is connected between an inverting input terminal and an output terminal of the operational amplifier (OP2), and a capacitor (C2) is connected between an inverting input terminal and the output terminal of the operational amplifier (OP2) through a switching circuit (SW2), and one terminal of a capacitor (C1) is connected to the inverting input terminal of the operational amplifier (OP2).

A reference voltage (Vcen) is applied to the non-inverting input terminal of the operational amplifier (OP2), and is applied through a switching circuit (SW3) to the other terminal of the capacitor (C1) and applied through a switching circuit (SW4) to one terminal of the capacitor (C2) on the side connected to the switching circuit (SW2).

Here, the reference voltage (Vcen) is also the potential of the LC driving voltage (Vcom) applied to the common electrode (ITO2).

In the inverting amplifier, during the reset operation, the switching circuit (SW1), the switching circuit (SW3) and the switching circuit (SW4) are turned on, and the switching circuit (SW2) is turned off. In this state, the operational amplifier (OP2) serves as a voltage follower and the potential of the output terminal and the inverting input terminal of the operational amplifier (OP2) becomes the reference voltage (Vcen), further the reference voltage (Vcen) is applied to other terminal of the capacitor (C1) and to the terminal on the side thereof connected to the switching circuit (SW2) and the capacitor (C1) and the capacitor (C2) are reset.

In the normal state, the switching circuit (SW1), the switching circuit (SW3) and the switching circuit (SW4) are turned off and the switching circuit (SW2) is turned on, and the gray scale voltage inputted through the capacitor (C1) is inverted and amplified with respect to the reference voltage (Vcen).

In the liquid crystal display device such as an active matrix type liquid crystal display module, the display area has been large-sized and for enhancement of aesthetic appeal of the display device and elimination of an unavailable space, it is required that an area other than the display area in the liquid crystal display device, that is, a frame border area is made as small as possible.

Therefore in the active matrix type liquid crystal display module shown in FIG. 13, the drain driver 530 is disposed on one side of the liquid crystal display panel (TFT-LCD) so that frame border area may be made small.

In the drain driver 530 of the active matrix type liquid crystal display module shown in FIG. 13, however, since a gray scale voltage inputted to the high-voltage inverting amplifier 571 or the low-voltage rail-to-rail amplifier 572 is switched by the switching circuit (1) 562, a large number of the switching circuits (IN1, IN2) constituting the switching circuit (1) shown in FIG. 22 are required, and are an obstacle to reduction of the frame border area of the liquid crystal display panel (TFT-LCD)

The high-voltage inverting amplifier 571 requires switch circuits (SW1–SW4) (FIG. 22) and a controller circuit for controlling the switch circuits (SW1–SW4), and increases a chip size of a semiconductor integrated circuit (IC chip) is an obstacle to reduction of the frame border area of the liquid crystal display panel (TFT-LCD).

The high-voltage inverting amplifier 571 includes capacitors (C1) and (C2) connected in series between its output terminal and the switches (IN1, IN2) and causes a problem that an unwanted current flows from the output terminal to the gray scale voltage generating circuit 551 and varies the level of the multi-gray scale voltages generated in the gray scale voltage generating circuit 551.

In order to solve the above-mentioned problems, for example, a voltage follower may be used as the high-voltage inverting amplifier 571, as in a low-voltage rail-to-rail amplifier 572. But the decoder circuit (1) 561 must be formed by high-voltage MOS transistors.

However, since the decoder circuit (1) formed of the high-voltage PMOS transistors and the high-voltage NMOS transistors requires a large area in the semiconductor integrated circuit, a chip size of the semiconductor integrated circuit (IC chip) constituting the drain driver 530 becomes large, and is an obstacle to reduction of the frame border area in the liquid crystal display panel (TFT-LCD).

Further, since the liquid crystal layer (LC) has a γ characteristic as shown in FIG. 16, the LC driving voltage applied to the pixel electrode (ITO1) must be different depending on the polarity of the LC driving voltage applied to the pixel electrode (ITO1). In the drain driver 530 of the active matrix type liquid crystal display module shown in FIG. 13, however, this is not considered at all.

SUMMARY OF THE INVENTION

In order to solve the above-mentioned problems in the prior art, one object of the present invention is to provide a method of driving a liquid crystal display device which can reduce a chip size of a semiconductor integrated circuit forming a video signal line driver.

Another object of the present invention is to provide a method of driving a liquid crystal display device which can make LC driving voltages to be applied to individual pixels different depending on polarity of the driving voltage without the need for increasing a chip size of a semiconductor integrated circuit forming a video signal line driver.

Another object of the present invention is to provide a method of driving a liquid crystal display device which can prevent variations in voltage levels of multi-gray scale voltages generated in a gray scale voltage generating circuit of a video signal line driver.

Another object of the present invention is to provide a method of driving a liquid crystal display device which can reduce the frame border area of a liquid crystal display panel, and improve the quality of the image displayed on the liquid crystal display.

According to an embodiment of the present invention to attain the foregoing objects, the present invention is in a method of driving a liquid crystal display device wherein the liquid crystal display device comprises:

a liquid crystal display panel having a plurality of video signal lines, a plurality of scanning signal lines orthogonal to the plurality of video signal lines, and a plurality of pixels each surrounded by two adjacent video signal lines among the plurality of video signal lines and by two adjacent scanning signal lines among the plurality of scanning signal lines and all arranged in a matrix;

a video signal line drive circuit connected to each of the plurality of video signal lines and outputting LC driving voltages to each of the plurality of video signal lines, said LC driving voltages to be applied to each of the plurality of pixels; and a display control circuit for controlling and driving the video signal line drive circuit, the method of driving the liquid crystal display device comprising the steps of: preparing a first drive voltage circuit constituted by a plurality of first output means having a latch circuit for latching display data and being connected to the latch circuit and outputting LC driving voltages of positive polarity corresponding to the display data and second output means having a latch circuit for latching display data and being connected to the latch circuit and outputting LC driving voltages of negative polarity corresponding to the display data, said plurality of first output means and said second output means being arranged alternately, and a second drive voltage circuit constituted by a plurality of first output means having a latch circuit for latching display data and being connected to the latch circuit and outputting LC driving voltages of positive polarity corresponding to the display data and second output means having a latch circuit for latching display data and being connected to the latch circuit and outputting LC driving voltages of negative polarity corresponding to the display data, said plurality of first output means and said second output means being arranged alternately in opposite polarity arrangement order to that of the first drive voltage circuit;

inputting the display data sequentially sent from the display control means to the latch circuits in the order of the first drive voltage circuit and the second drive voltage circuit;

supplying outputs from the latch circuits to each of the plurality of video signal lines in the order of the first drive voltage circuit and the second drive voltage circuit;

inputting the display data sequentially sent from the display control means to the latch circuits in the order of the second drive voltage circuit and the first drive voltage circuit, based on the display control signal sent from the display control circuit; and supplying outputs from the latch circuits to each of the plurality of video signal lines in the order of the second drive voltage circuit and the first drive voltage circuit.

According to another embodiment of the present invention to attain the foregoing objects, the present invention is in a method of driving a liquid crystal display device wherein the liquid crystal display device comprises:

a liquid crystal panel having a plurality of video signal lines, a plurality of scanning signal lines orthogonal to the plurality of video signal lines, and a plurality of pixels each surrounded by two adjacent video signal lines among the plurality of video signal lines and by two adjacent scanning signal lines among the plurality of scanning signal lines and all arranged in a matrix;

a video signal line drive circuit connected to each of the plurality of video signal lines and outputting LC driving voltages to each of the plurality of video signal lines, said LC driving voltages to be applied to each of the plurality of pixels; and a display control circuit for controlling and driving the video signal line drive circuit, the method of driving the liquid crystal display device comprising the steps of:

preparing a plurality of output means comprising first output means having a latch circuit for latching display data and being connected to the latch circuit and outputting gray scale voltages of positive polarity corresponding to the display data and second output means also generating gray scale voltages of negative polarity corresponding to the display data, and a pair of a plurality of first output circuits outputting LC driving voltages of positive polarity corresponding to the gray scale voltages of positive polarity to each of the plurality of output means and a plurality of second output circuits outputting LC driving voltages of negative polarity corresponding to the gray scale voltages of negative polarity to each of the plurality of output means;

inputting the display data sequentially sent from the display control circuit to the latch circuits;

outputting gray scale voltages of positive polarity from the first output circuit being one of adjacent output means and inputting the gray scale voltages to the first circuit and supplying the LC driving voltages of positive polarity to one of the adjacent video signal lines;

outputting gray scale voltages of negative polarity from the second output circuit being other of the adjacent output means and inputting the gray scale voltages to the second circuit and supplying the LC driving voltages of negative polarity to other of the adjacent video signal lines;

outputting gray scale voltages of negative polarity from the first output circuit being one of adjacent output means, based on the display control signal sent from the display control circuit, and inputting the gray scale voltages to the second circuit and supplying the LC driving voltages of negative polarity to one of the adjacent video signal lines;

outputting gray scale voltages of positive polarity from the second output circuit being other of adjacent output means and inputting the gray scale voltages to the second circuit and supplying the LC driving voltages of negative polarity to other of the adjacent video signal lines;

outputting gray scale voltages of positive polarity from the first output circuit being one of adjacent output means, based on the display control signal sent from the display control circuit, and inputting the gray scale voltages to the first circuit and supplying the LC driving voltages of positive polarity to one of the adjacent video signal lines; and outputting gray scale voltages of negative polarity from the second output circuit being other of adjacent output means and inputting the gray scale voltages to the second circuit and supplying the LC driving voltages of negative polarity to other of the adjacent video signal lines.

BRIEF DESCRIPTION OF THE DRAWINGS

In the drawings, which form an integral part of the specification and are to be read in conjunction therewith, and in which like reference numerals designate similar components throughout the figures, and in which.

DETAILED DESCRIPTION OF THE PREFERRED EMBODIMENTS

Figure 1:
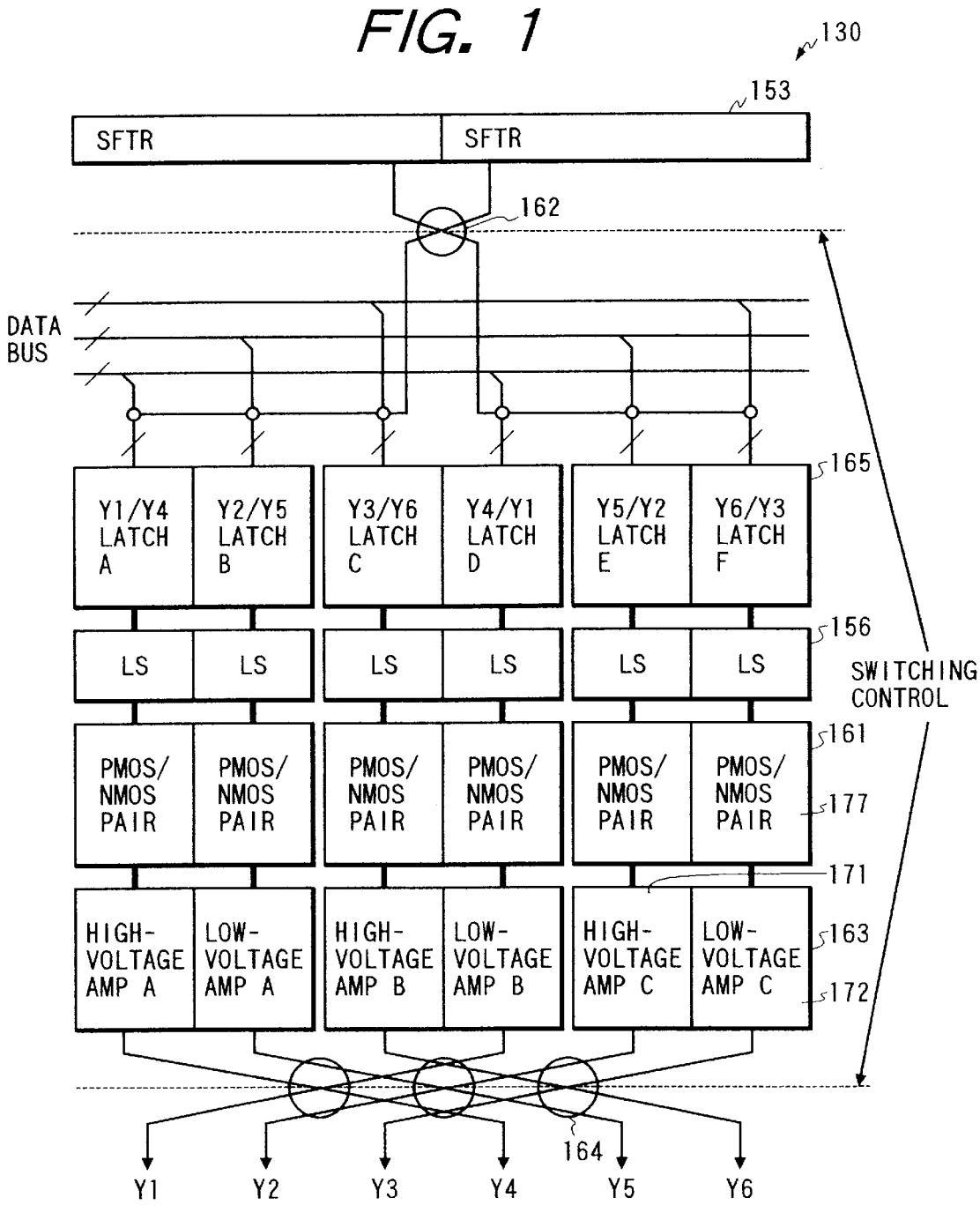
FIG. 1 is a block diagram explaining a configuration of a drain driver 130 in a first embodiment of the present invention centering upon a configuration of an output circuit.

Embodiments of the present invention applied to an active matrix type liquid crystal display module which is one of liquid crystal display devices of the vertical field active matrix type will be described in detail referring to the accompanying drawings.

In all drawings illustrating embodiments of the present invention, components having the same function is designated by the same reference numeral and the repeated description shall be omitted.

Embodiment 1

Figure 13:
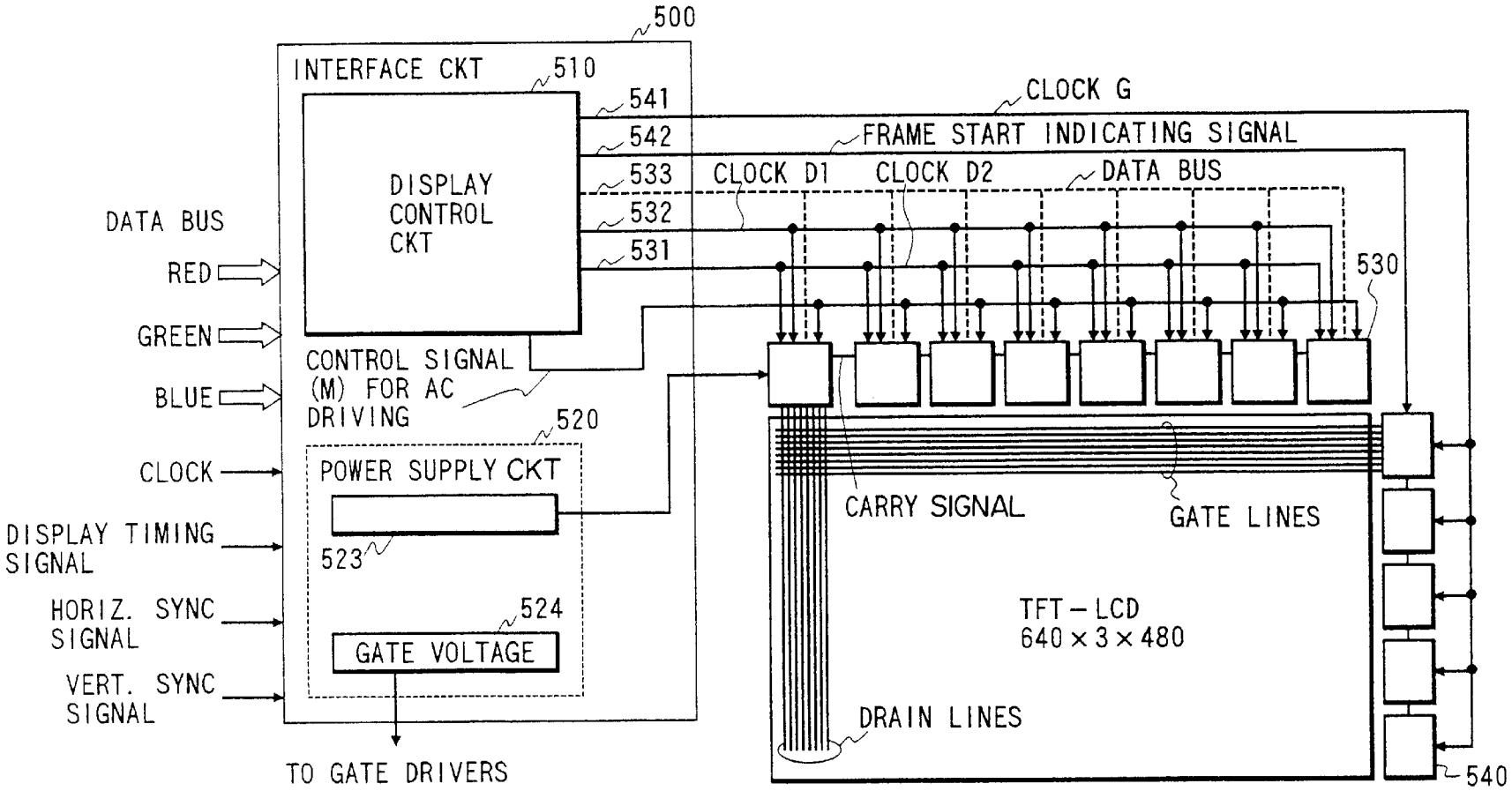
FIG. 13 is a block diagram showing a schematic configuration of an active matrix type liquid crystal display module which is one of a vertical field active matrix type liquid crystal display device of the prior art.
Figure 14:
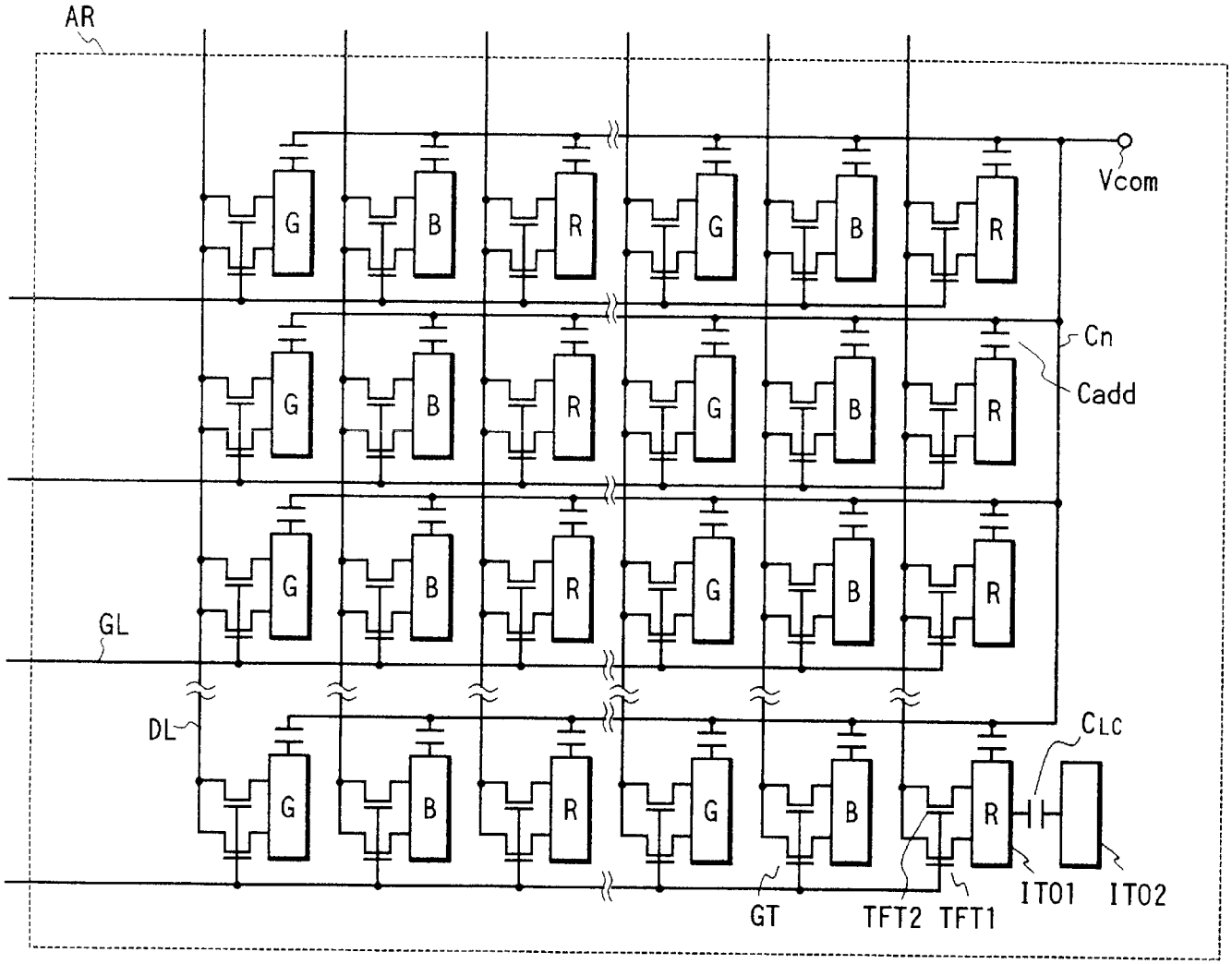
FIG. 14 is a diagram showing an equivalent circuit of a liquid crystal display panel (TFT-LCD) shown in FIG. 13.
Figure 15:
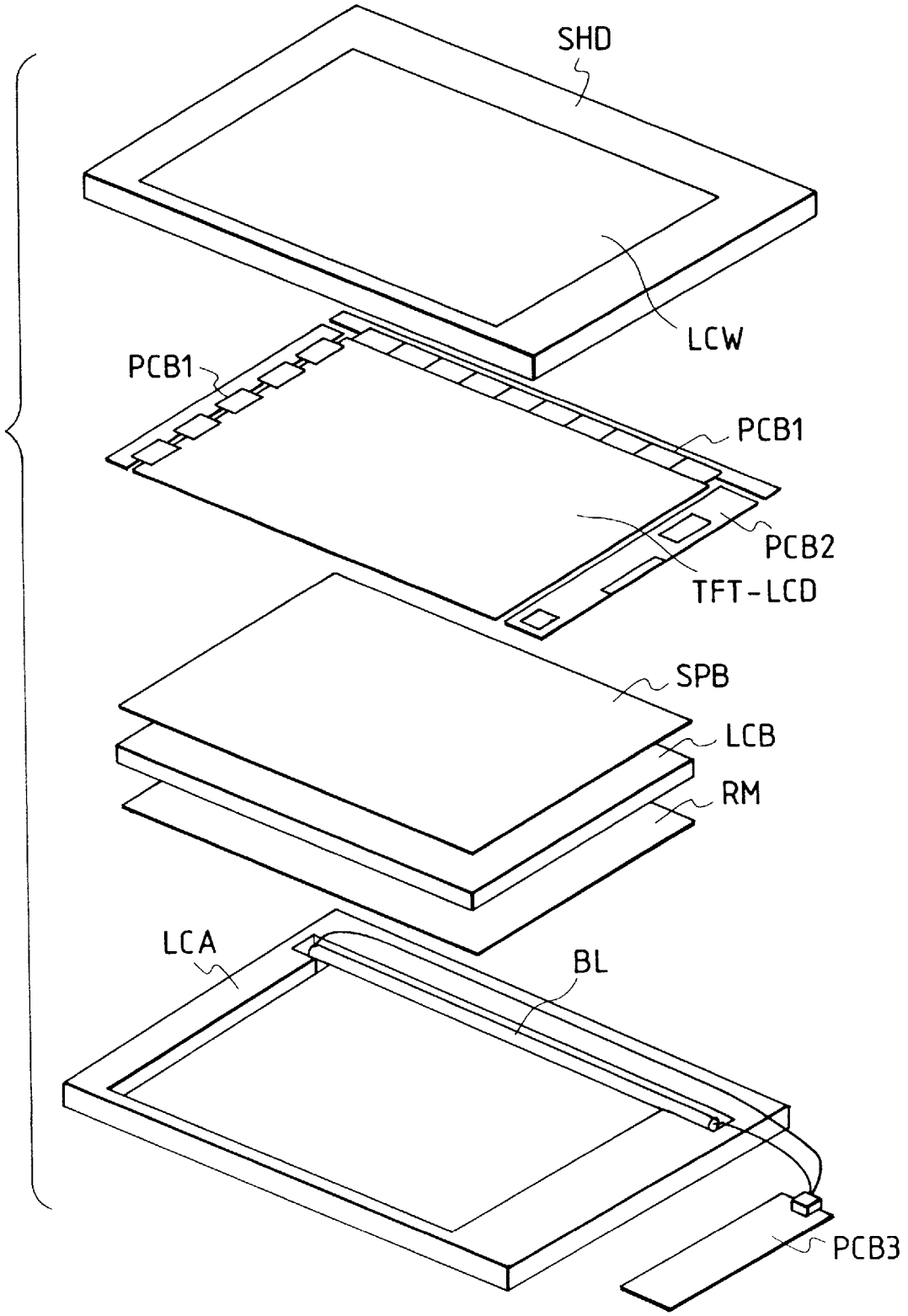
FIG. 15 is an exploded perspective view showing components of an active matrix type liquid crystal display module in FIG. 13.
Figure 16:
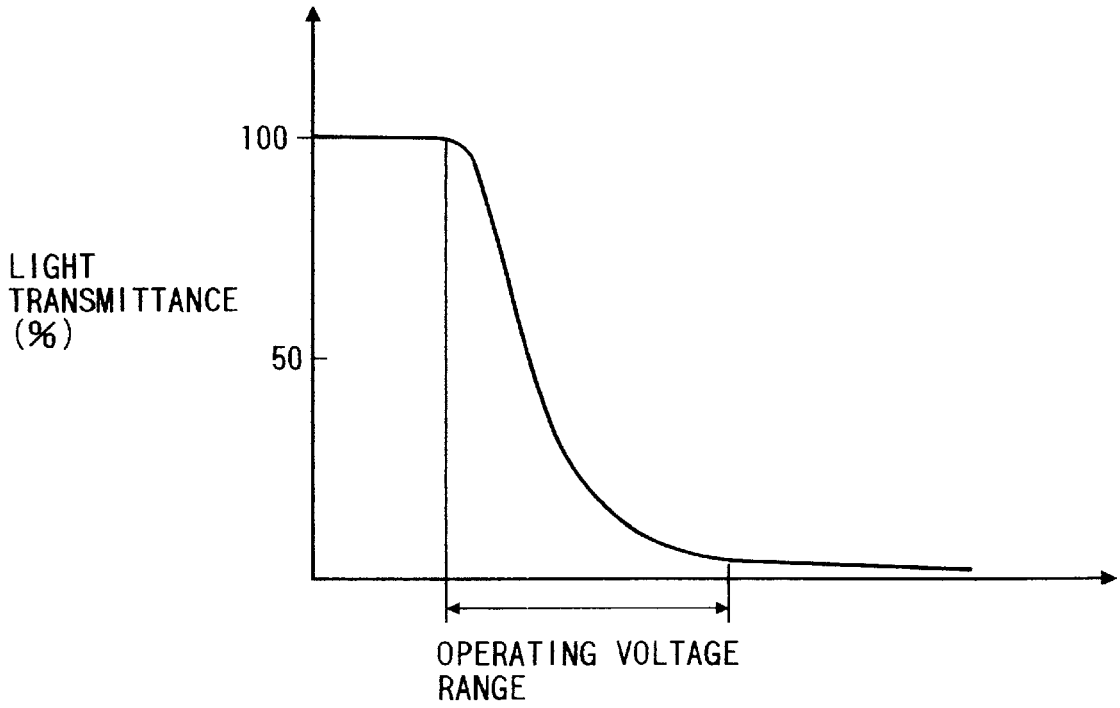
FIG. 16 is a graph showing a relationship of an LC driving voltage applied across an LC layer and light transmittance of the LC layer.
Figure 17A:
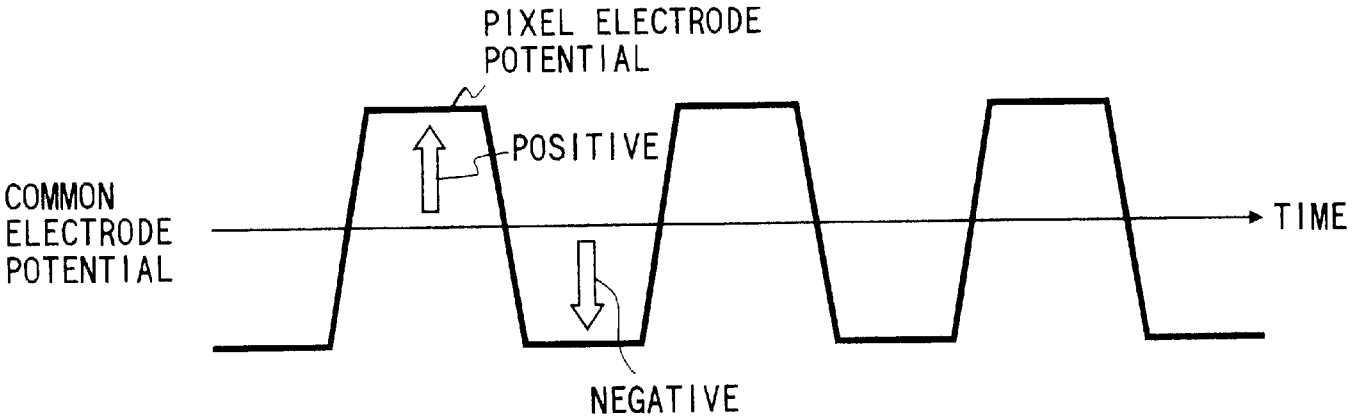
FIGS. 17A and 17B are diagrams explaining application of AC voltages across an LC layer by a fixed common-electrode voltage drive method and a common-electrode voltage inversion drive method, respectively.
Figure 17B:
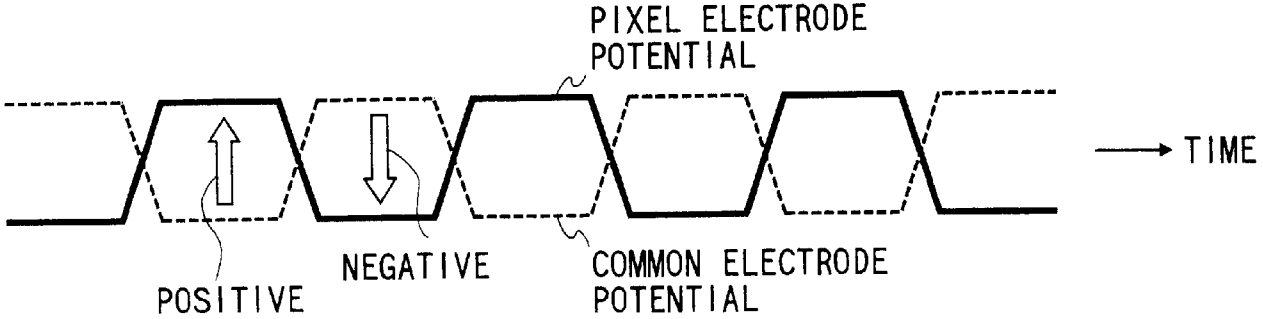
Figure 18:
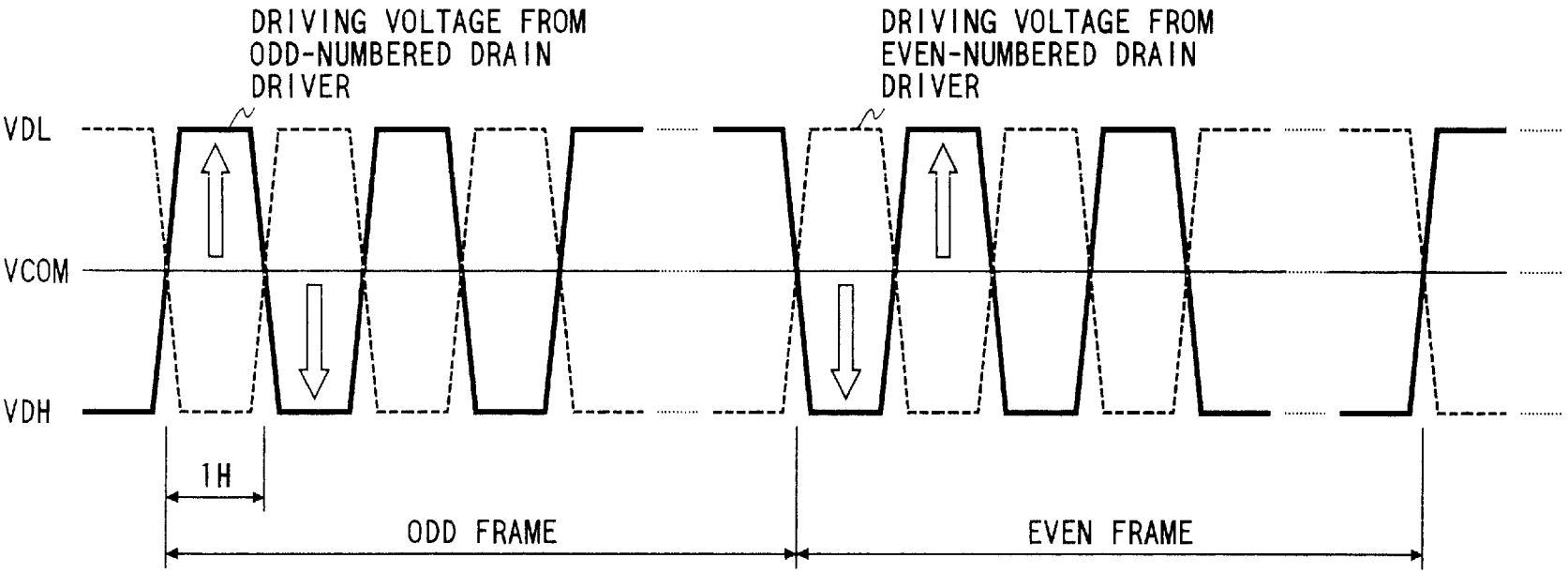
FIG. 18 is a diagram showing a relationship between an LC driving voltage applied to a pixel electrode (ITO1) and a driving voltage applied to a common electrode (ITO2) from a drain driver 530 shown in FIG. 13.

A schematic configuration of an embodiment of the present invention applied to an active matrix type liquid crystal display module is similar to that of the active matrix type liquid crystal display module of the prior art shown in FIG. 13.

A drain driver (video signal line driver) is disposed at the top of a liquid crystal display panel (TFT-LCD), and each video signal line (drain signal line or vertical signal line) (DL) of the liquid crystal display panel (TFT-LCD) is connected to the drain driver.

A gate driver (vertical scanning circuit) and an interface circuit are disposed at the side of the liquid crystal display panel (TFT-LCD), and each scanning signal line (gate signal line or horizontal signal line) (GL) of the liquid crystal display panel (TFT-LCD) is connected to the gate driver.

Figure 19:
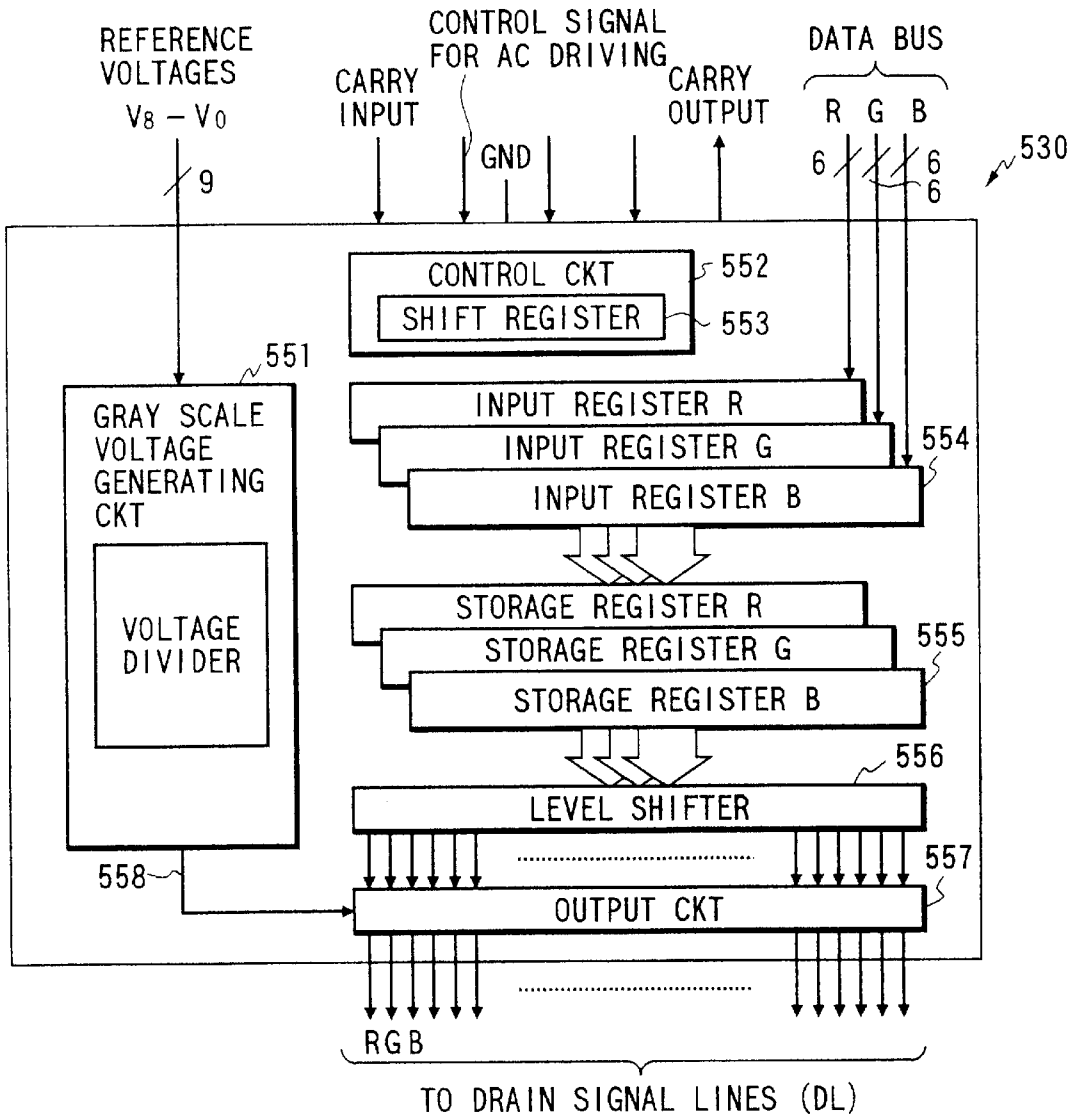
FIG. 19 is a block diagram showing a schematic configuration of a drain driver shown in FIG. 13.

A schematic configuration of a drain driver 130 is similar to that of the drain driver 530 shown in FIG. 19. The drain driver 130 has a gray scale voltage generating circuit (551 in FIG. 19), a shift register (553 in FIG. 19) in the control circuit 552, an input register (554 in FIG. 19), a storage register (555 in FIG. 19), a level shifter circuit (1) (556 in FIG. 19) and an output circuit (557 in FIG. 19).

The gray scale voltage generating circuit generates 64 levels of gray scale voltages based on nine gray scale reference voltages (V0–V8) inputted from a voltage generating circuit, and outputs gray scale voltages through voltage bus lines (558 in FIG. 19) to the output circuit.

The shift register in the control circuit generates a data input control signal based on a display data latch clock (D2) inputted from a display control circuit, and the input register latches display data of six bits per color corresponding in number to the outputs and the storage register latches display data from the input register in response to the output timing control clock (D1) inputted from the display control circuit.

The display data inputted to the storage register are inputted through a level shifter circuit (1) to the output circuit.

FIG. 1 is a block diagram explaining a configuration of a drain driver 130 in a first embodiment of the present invention centering upon a configuration of an output circuit.

In FIG. 1, reference numeral 153 designates a shift register, numeral 156 designates a level shifter circuit (1), numeral 161 designates a decoder circuit (1), numeral 162 designates a switching circuit (3), numeral 163 designates an amplifier circuit pair, numeral 164 designates a switching circuit (2), and numeral 165 designates a data latch circuit.

Here, the decoder circuit (1) 161 comprises a complementary decoder circuit 177 formed of PMOS and NMOS transistors, and the amplifier circuit pair 163 is formed of a high-voltage inverting amplifier 171 and a low-voltage rail-to-rail amplifier 172.

In FIG. 1, the decoder (1) 161 and the switching circuit (2) 164 for switching between outputs of the amplifier circuit pair 163 constitute an output circuit (557 in FIG. 19), and the shift register 153 indicates a shift register (553 in FIG. 19) in the control circuit and the data latch circuit 165 indicates an input register (554 in FIG. 19) and a storage register (555 in FIG. 19).

Further in FIG. 1, Y1 through Y6 designate the first through sixth video signal lines (DL) respectively.

Figure 21:
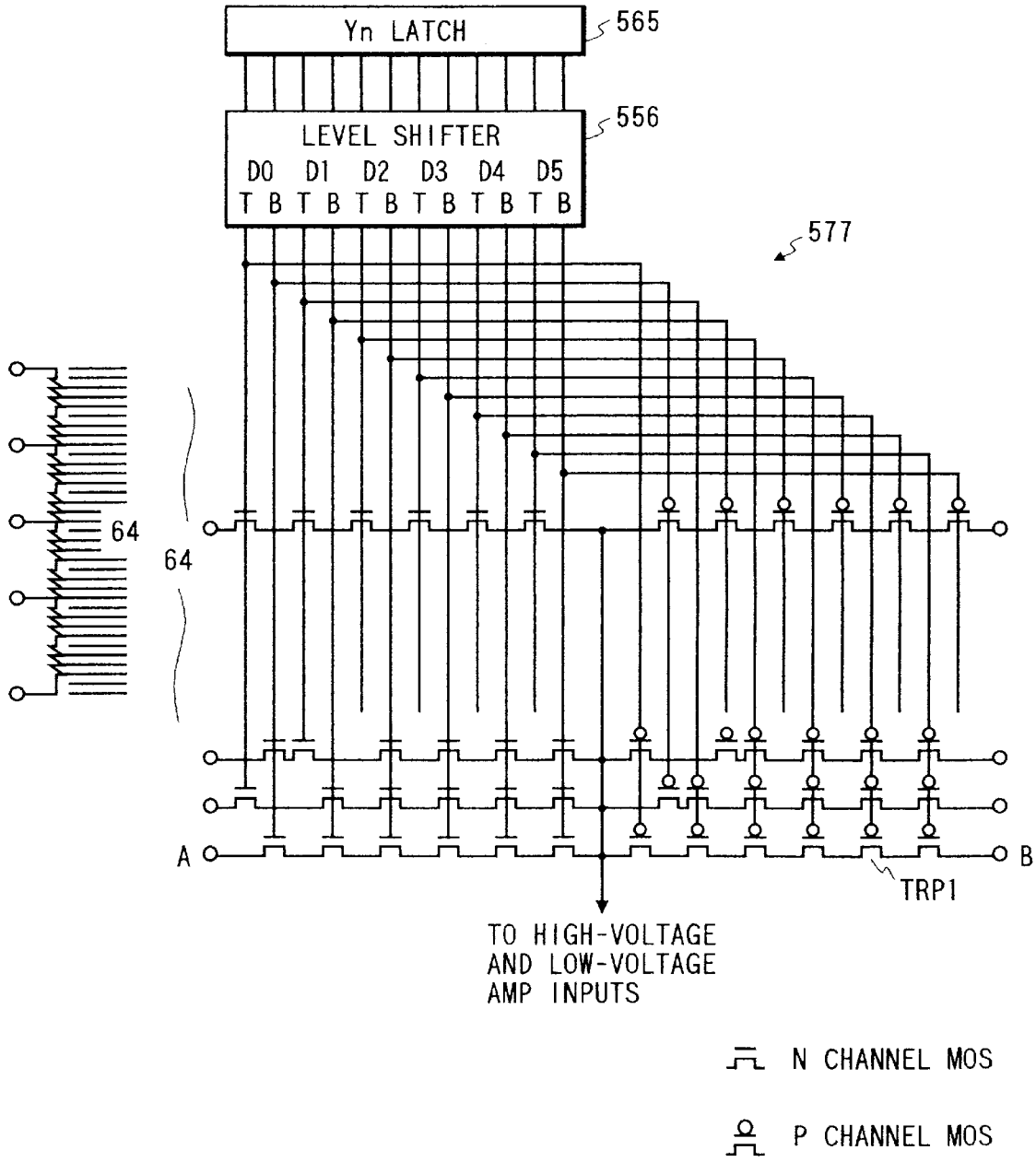
FIG. 21 is a circuit diagram showing a circuit configuration of a decoder circuit 577 shown in FIG. 20.
Figure 22:
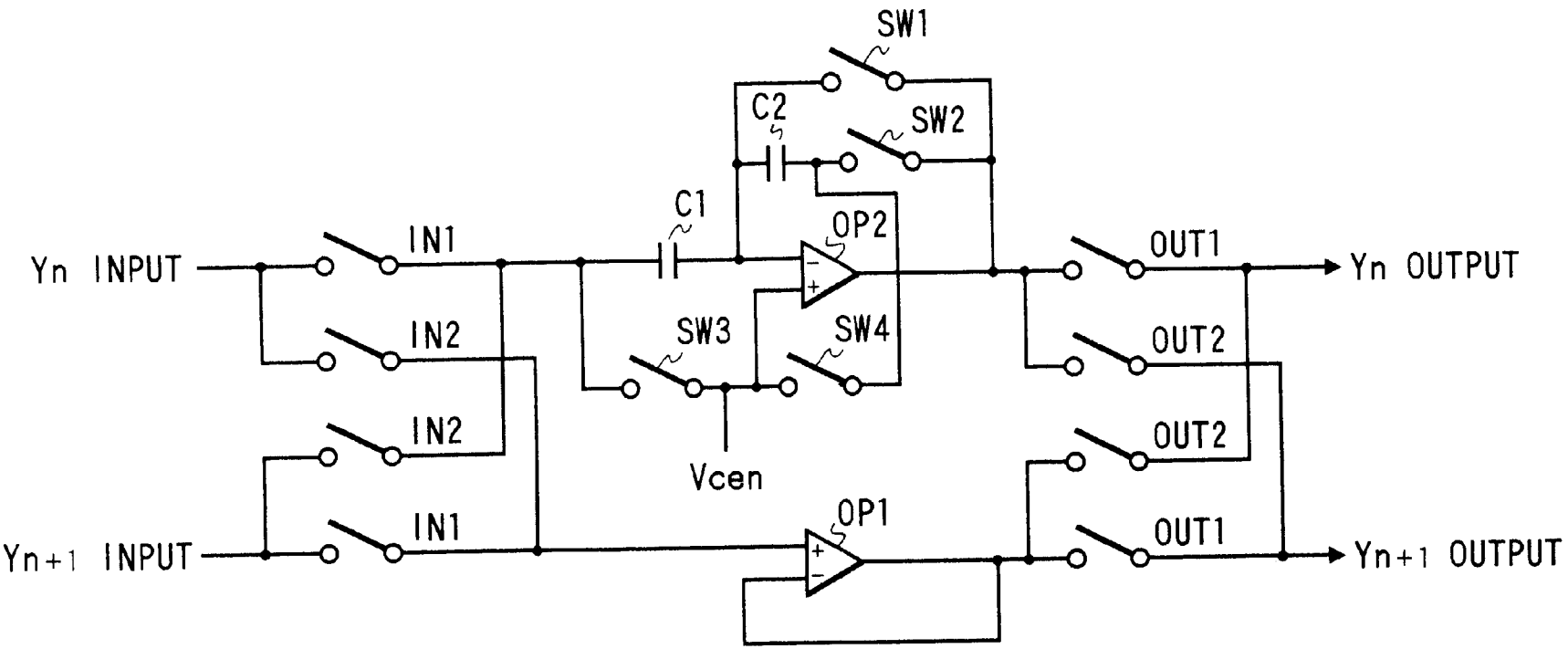
FIG. 22 is a circuit diagram showing a circuit configuration of a switching circuit (1) 562, an amplifier circuit pair 563 and a switching circuit (2) 564 shown in FIG. 20.

Here, the decoder circuit 177 has the same circuit configuration as that of the decoder circuit 577 shown in FIG. 21, and the high-voltage inverting amplifier 171 and the low-voltage rail-to-rail amplifier 172 constituting the amplifier circuit pair 163 have the same circuit configuration as that of the high-voltage inverting amplifier 571 and the low-voltage rail-to-rail amplifier 572 shown in FIG. 22, respectively.

The switching circuit (3) 162 and the switching circuit (2) 164 are controlled based on a control signal (M) for AC driving, and since the switching circuit (2) 164 is formed of high-voltage MOS transistors, the control signal (M) for AC driving applied to the gate electrode of the high-voltage MOS transistor of the switching circuit (2) 164 is level-shifted to the high voltage signal level.

Figure 2:
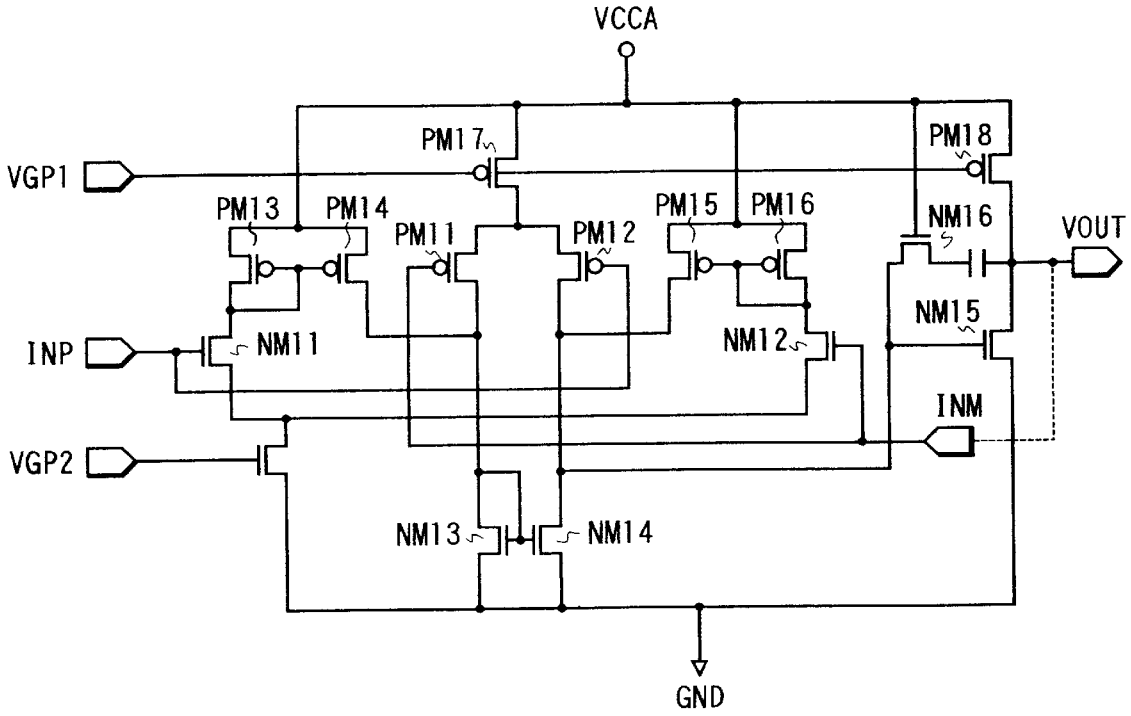
FIG. 2 is a circuit diagram showing an example of an operational amplifier (OP1) used in a low-voltage rail-to-rail amplifier 172 forming an amplifier circuit pair 163.

FIG. 2 is a circuit diagram showing an example of an operational amplifier (OP1) (see FIG. 22) used in the low-voltage rail-to-rail amplifier 172 constituting the amplifier circuit pair 163.

The operational amplifier (OP1) shown in FIG. 2 is comprised of an input amplifier stage and a current amplifier stage, and the input amplifier stage includes a first differential amplifier comprising PMOS transistors (PM11, PM12) and a second differential amplifier comprising NMOS transistors (NM11,NM12).

Output currents of the second differential amplifier are returned and added to the input currents of the first differential amplifier by a current mirror circuit formed by PMOS transistors (PM13, PM14) and a current mirror circuit formed by PMOS transistors (PM15, PM16), respectively.

An active load comprising a current mirror circuit formed of NMOS transistors (NM13, NM14) is connected to the first differential amplifier.

The current amplifier stage is comprised of a series circuit of an NMOS transistor (NM15) to whose gate electrode is applied the drain voltage of the PMOS transistor (PM12) and a constant-current source.

PMOS transistors (PM17, PM18) to whose gate electrodes is applied the bias voltage constitute a constant-current source, and VGP1 and VGP2 indicate bias voltage sources.

The NMOS transistor (NM16) constitutes a resistor, and each MOS transistor is a low-voltage MOS transistor.

Here, INP represents a noninverting input terminal (+), INM represents an inverting input terminal (−), and VOUT represents an output terminal.

A voltage follower is formed by connecting the inverting input terminal (INM) and the output terminal (VOUT) directly as shown by a dotted line in FIG. 2.

Figure 3:
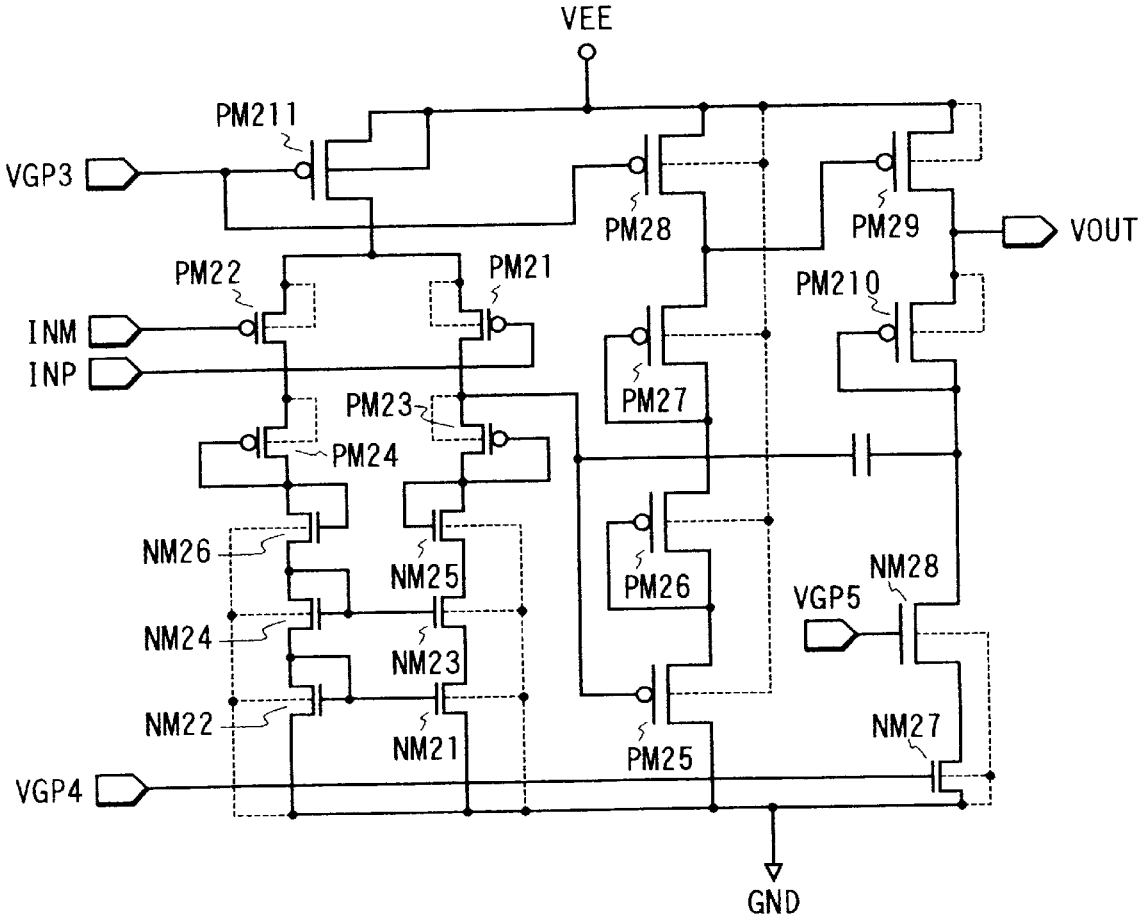
FIG. 3 is a circuit diagram showing an example of an operational amplifier (OP2) used in a high-voltage inverting amplifier 171 forming an amplifier circuit pair 163.

FIG. 3 is a circuit diagram showing an example of an operational amplifier (OP2) (see FIG. 22) to be used in the high-voltage inverting amplifier 171 constituting the amplifier circuit pair 163.

The operational amplifier shown in FIG. 3 is formed by an input amplifier stage, a level shift stage and a current amplifier stage. The input amplifier stage is constituted by a differential amplifier comprising PMOS transistors (PM21, PM22), and an active load comprising a current mirror circuit formed by NMOS transistors (NM21–NM24) is connected to the differential amplifier via a series circuit of a PMOS transistor (PM23) and an NMOS transistor (NM25) each of which is in a diode connection and a series circuit of a PMOS transistor (PM24) and an NMOS transistor (NM26) each of which is in a diode connection.

The level shift stage is constituted by a PMOS transistor (PM25) to whose gate electrode is connected the drain voltage of the PMOS transistor (PM21), PMOS transistors (PM26, PM27) each of which is in a diode connection, and a constant-current source.

The current amplifier stage is formed by a PMOS transistor (PM29) to whose gate electrode is connected the source voltage of the PMOS transistor (PM27), a PMOS transistor (PM210) in a diode connection, and a constant-current source.

The PMOS transistors (PM28, PM211) and the NMOS transistors (NM27, NM28) to whose gate electrodes are connected bias voltages, constitute a constant-current source, and VGP3, VGP4 and VGP5 indicate bias voltage sources.

In FIG. 3, MOS transistors designated by large-sized symbols indicate high-voltage MOS transistors.

Figure 20:
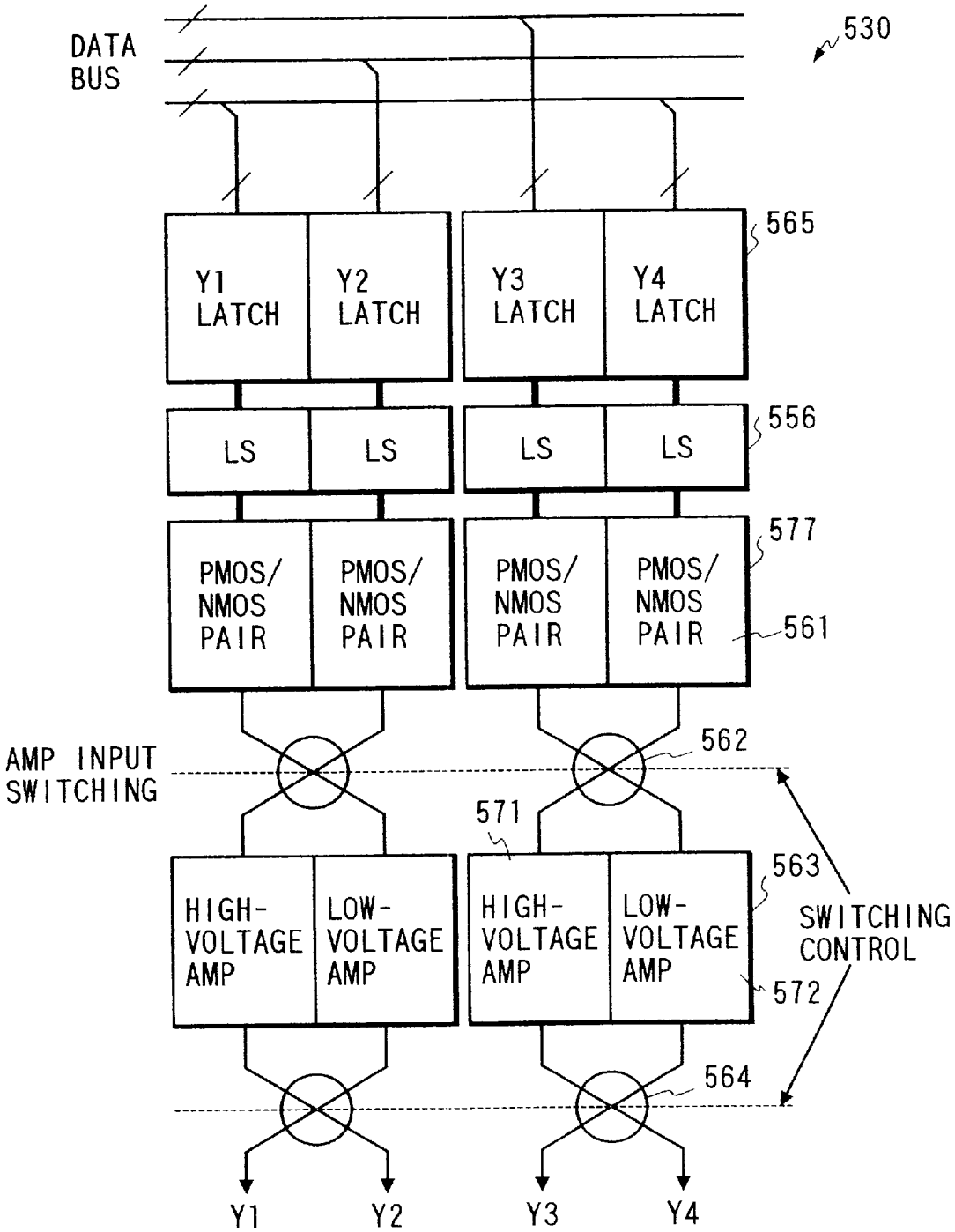
FIG. 20 is a block diagram explaining a configuration of a drain driver 530 centering upon a configuration of an output circuit 557 shown in FIG. 19.

While in the drain driver 530 shown in FIG. 20, a gray scale voltage outputted from each decoder circuit 577 is inputted alternately to one of the high-voltage inverting amplifier 171 and the low-voltage rail-to-rail amplifier 172 of the amplifier circuit pair 563 by the switching circuit (1) 562, in the drain driver 130 in the first embodiment of the present invention, a data input control signal to be inputted to the data latch circuit 165 (specifically, the input register 554 in FIG. 19) is inputted alternately to one of two adjacent groups of the adjacent data latch circuits 165 by the switching circuit (3) 162.

In the dot-inversion drive method, two LC driving voltages outputted to two adjacent video signal lines (DL), respectively, are opposite in polarity with respect to the LC driving voltage applied to the common electrode (ITO1). Assume that video signal lines Y1, Y2, Y3, Y4, . . . Yn form repeating groups of triads of video signal lines for supplying LC driving voltages for red (R), green (G), blue (B) signals, respectively, and that Y1 supplies an LC driving voltage of positive polarity, Y2 an LC driving voltage of negative polarity, Y3 an LC driving voltage of positive polarity, Y4 an LC driving voltage of negative polarity, Y5 an LC driving voltage of positive polarity, Y6 an LC driving voltage of negative polarity.

When the polarity of LC driving voltages from the video signal lines (DL) for the same color is considered, as for red the video signal line Y1 is positive in polarity and Y4 is negative in polarity; as for green the video signal line Y2 is negative in polarity and Y5 is positive in polarity; and as for blue the video signal line Y3 is positive in polarity and Y6 is negative in polarity.

Thus with the dot-inversion drive method, the LC driving voltages from the two nearest signal lines for the same color are opposite in polarity from each other, and the high-voltage inverting amplifier 171 and the low-voltage rail-to-rail amplifier 172 in the amplifier circuit pair 163 are arranged such that the high-voltage inverting amplifier 171→the low-voltage rail-to-rail amplifier 172→the high-voltage inverting amplifier 171→the low-voltage rail-to-rail amplifier 172. A data input control signal to be inputted to the data latch circuit 165 is inputted alternately to one of two adjacent groups of the adjacent data latch circuits 165 by the switching circuit (3) 162. In synchronization with this, output voltages from the high-voltage inverting amplifier 171 and the low-voltage rail-to-rail amplifier 172 are supplied to the video signal lines, for example, the first video signal line Y1 and the fourth video signal line Y4, respectively, by the switching circuit (2) 164 such that an LC driving voltage of the intended polarity is supplied to each video signal line.

Specifically, the control signal (M) for AC driving switches between the state 1 connection and state 2 connection as indicated below referring to FIG. 1.

State 1

Y1 video signal→Y1/Y4 latch A→high-voltage inverting amplifier A→video signal line Y1

Y2 video signal→Y2/Y5 latch B→low-voltage rail-to-rail amplifier A→video signal line Y2

Y3 video signal→Y3/Y6 latch C→high-voltage inverting amplifier B→video signal line Y3

Y4 video signal→Y4/Y1 latch D→low-voltage rail-to-rail amplifier B→video signal line Y4

Y5 video signal→Y5/Y2 latch E→high-voltage inverting amplifier C→video signal line Y5

Y6 video signal→Y6/Y3 latch F→low-voltage rail-to-rail amplifier C→video signal line Y6

State 2

Y1 video signal→Y4/Y1 latch D→low-voltage rail-to-rail amplifier B→video signal line Y1

Y2 video signal→Y5/Y2 latch E→high-voltage inverting amplifier C→video signal line Y2

Y3 video signal→Y6/Y3 latch F→low-voltage rail-to-rail amplifier C→video signal line Y3

Y4 video signal→Y1/Y4 latch A→high-voltage inverting amplifier A→video signal line Y4

Y5 video signal→Y2/Y5 latch B→low-voltage rail-to-rail amplifier A→video signal line Y5

Y6 video signal→Y3/Y6 latch C→high-voltage inverting amplifier B→video signal line Y6

In this case, the number of signal lines for data input control signal outputted from the shift register 153 is decreased to one third of the number of the video signal lines (DL), and since the data input control signal outputted from the shift register 153 is a digital signal, a switching circuit forming the switching circuit (3) 162 can be formed by unipolar MOS transistors including low-voltage PMOS or NMOS transistors.

If the number of the video signal lines (DL) connected to the drain driver 130 is 3n in the drain driver 130 in the first embodiment of the present invention, since one switching circuit (3) 162 is provided for two triads of signal lines for red (R), green (G), blue (B) signals, the number (MI) of the switching circuit (3) 162 is expressed by the following formula (1).

$$MI=3n/(3\times 2)=n/2 \quad (1)$$

As shown in FIG. 22, if the switching circuit (3) 162 is constituted by four switching circuits and each switching circuit is constituted by a unipolar MOS transistor, the number (TM1) of MOS transistors constituting the switching circuit (1) 162 in the drain driver 130 of the first embodiment of the present invention is expressed by following formula (2).

$$TM1=MI\times 4=2n \quad (2)$$

In the drain driver 530 shown in FIG. 20, since the switching circuit (1) 562 is provided for each pair of adjacent video signal lines (DL), the number (M"I) of the switching circuit (1) 562 is expressed by the following formula (3).

$$M''I=3n/2 \quad (3)$$

As shown in FIG. 22, when the switching circuit (1) 562 is constituted by four switching circuits and each switching circuit is constituted by complementary MOS transistors, the number (TM"1) of MOS transistors constituting the switching circuit (1) 562 in the drain driver 530 shown in FIG. 20 is expressed by the following formula (4).

$$TM''1=M''I\times 8=12n \quad (4)$$

Thus with the drain driver 130 in the first embodiment of the present invention, the number of the switching circuits constituting the switching circuit (3) 162 can be reduced to one sixth of the drain driver 530 in FIG. 20.

Consequently with the drain driver 130 in the first embodiment of the present invention, a chip size of the semiconductor integrated circuit (IC chip) constituting the drain driver 130 can be made smaller and reduction of the frame border area of the liquid crystal display panel (TFT-LCD) becomes possible.

Since the dot-inversion drive method is used as driving system, the voltage level of the common electrode (ITO2) is stable and deterioration of the display quality can be minimized.

Embodiment 2

The high-voltage inverting amplifier 171 of the drain driver 130 in the first embodiment of the present invention requires the switching circuits (SW1–SW4) (refer to FIG. 22) and a control circuit for controlling the switching circuits (SW1–SW4).

Also, in the high-voltage inverting amplifier 171 of the drain driver 130 in the first embodiment of the present invention, since the switching circuit (SW1) in the OFF-state is connected in parallel to the capacitor (C2) during normal operation as shown in FIG. 22, stray capacitance of the switching circuit (SW1) in the OFF-state is connected in parallel to the capacitor (C2) during normal operation, and desired output voltages cannot be obtained.

Since a series circuit of the capacitor (C1) and the capacitor (C2) is connected between the output terminal of the high-voltage inverting amplifier 171 and each switch (IN1, IN2), an unwanted current flows from the output terminal of the high-voltage inverting amplifier 171 to the gray scale voltage generating circuit and varies the voltage level of multi-gray scale voltages generated in the gray scale voltage generating circuit.

In an active matrix type liquid crystal display module of a second embodiment of the present invention, a voltage follower is used as the high-voltage inverting amplifier 171.

Further, considering gamma characteristics of the LC layer, the LC driving voltages applied to the pixel electrode (ITO1) are made different depending on the polarity of the LC driving voltages applied to the pixel electrode (ITO1).

Figure 4:
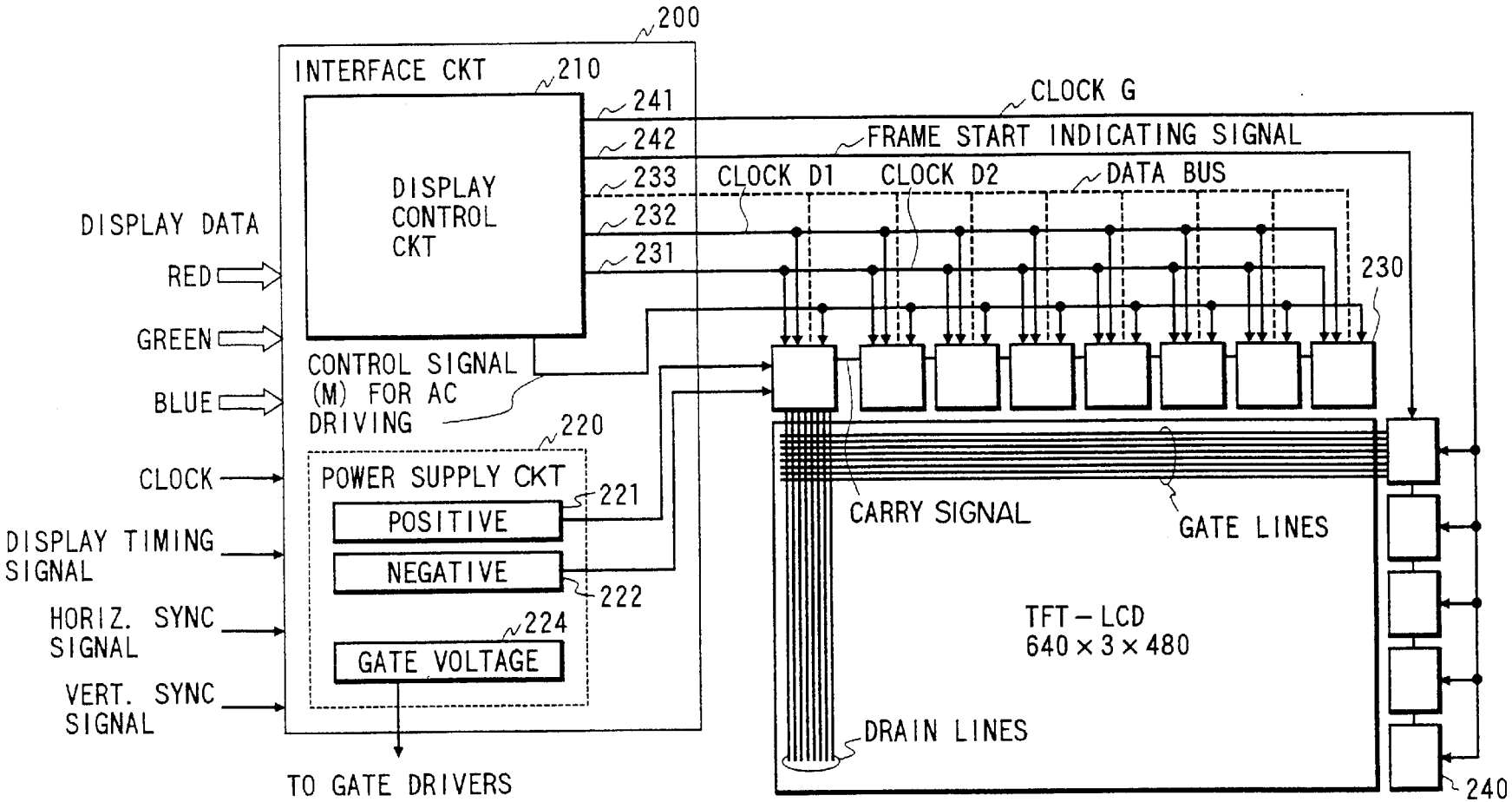
FIG. 4 is a block diagram showing a schematic configuration of an active matrix type liquid crystal display module in a second embodiment of the present invention.

FIG. 4 is a block diagram showing a schematic configuration of an active matrix type liquid crystal display module of a second embodiment of the present invention.

As shown in FIG. 4, the active matrix type liquid crystal display module of the second embodiment of the present invention is different from the active matrix type liquid crystal module in the first embodiment of the present invention in that a power supply circuit 220 in an interface circuit 200 is constituted by a positive-polarity voltage generating circuit 221 and a negative-polarity voltage generating circuit 222.

The positive-polarity voltage generating circuit 221 and the negative-polarity voltage generating circuit 222 are constituted by a voltage divider comprised of series resistors. The positive-polarity voltage generating circuit 221 outputs five gray scale reference voltages (V0–V4) of positive polarity, and the negative-polarity voltage generating circuit 222 outputs five gray scale reference voltages (V"5–V"9) of negative polarity.

Figure 5:
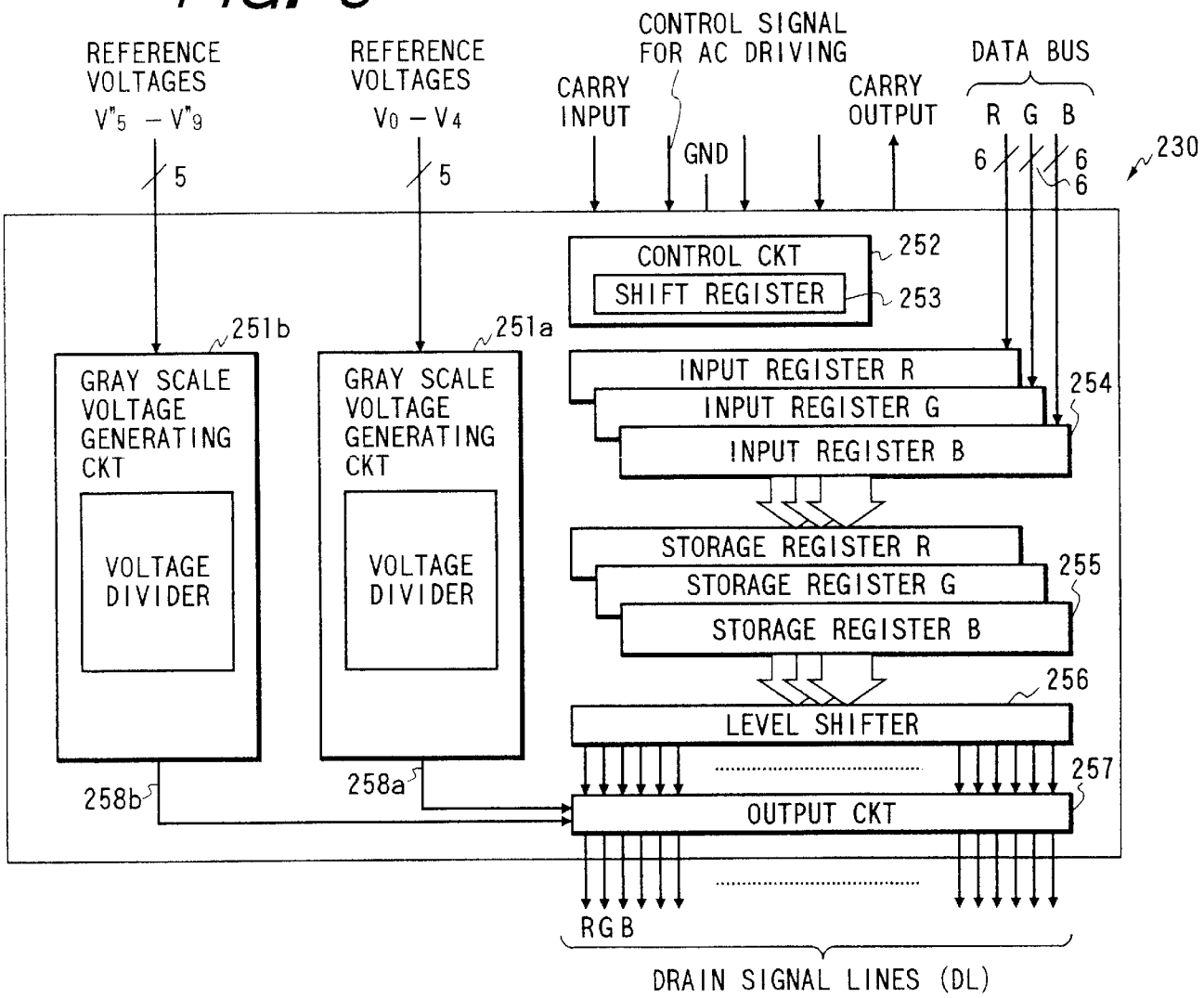
FIG. 5 is a block diagram showing a schematic configuration of a drain driver 230 shown in FIG. 4.

FIG. 5 is a block diagram showing a schematic configuration of a drain driver 230 shown in FIG. 4.

As shown in FIG. 5, the drain driver 230 includes two gray scale voltage generating circuits, a positive-polarity gray scale voltage generating circuit 251*a* and a negative-polarity gray scale voltage generating circuit 251*b*.

The positive-polarity gray scale voltage generating circuit 251*a* generates 64 levels of gray scale voltages of positive polarity based on five gray scale reference voltages (V0–V4) of positive polarity inputted from the positive-polarity voltage generating circuit 221, and outputs the gray scale voltages through a voltage bus line 258*a* to an output circuit 257.

The negative-polarity gray scale voltage generating circuit 251*b* generates 64 levels of gray scale voltages of negative polarity based on five gray scale reference voltages (V"5–V"9) of negative polarity inputted from the negative-polarity voltage generating circuit 222, and outputs the gray scale voltages through a voltage bus line 258*b* to the output circuit 257.

Figure 6:
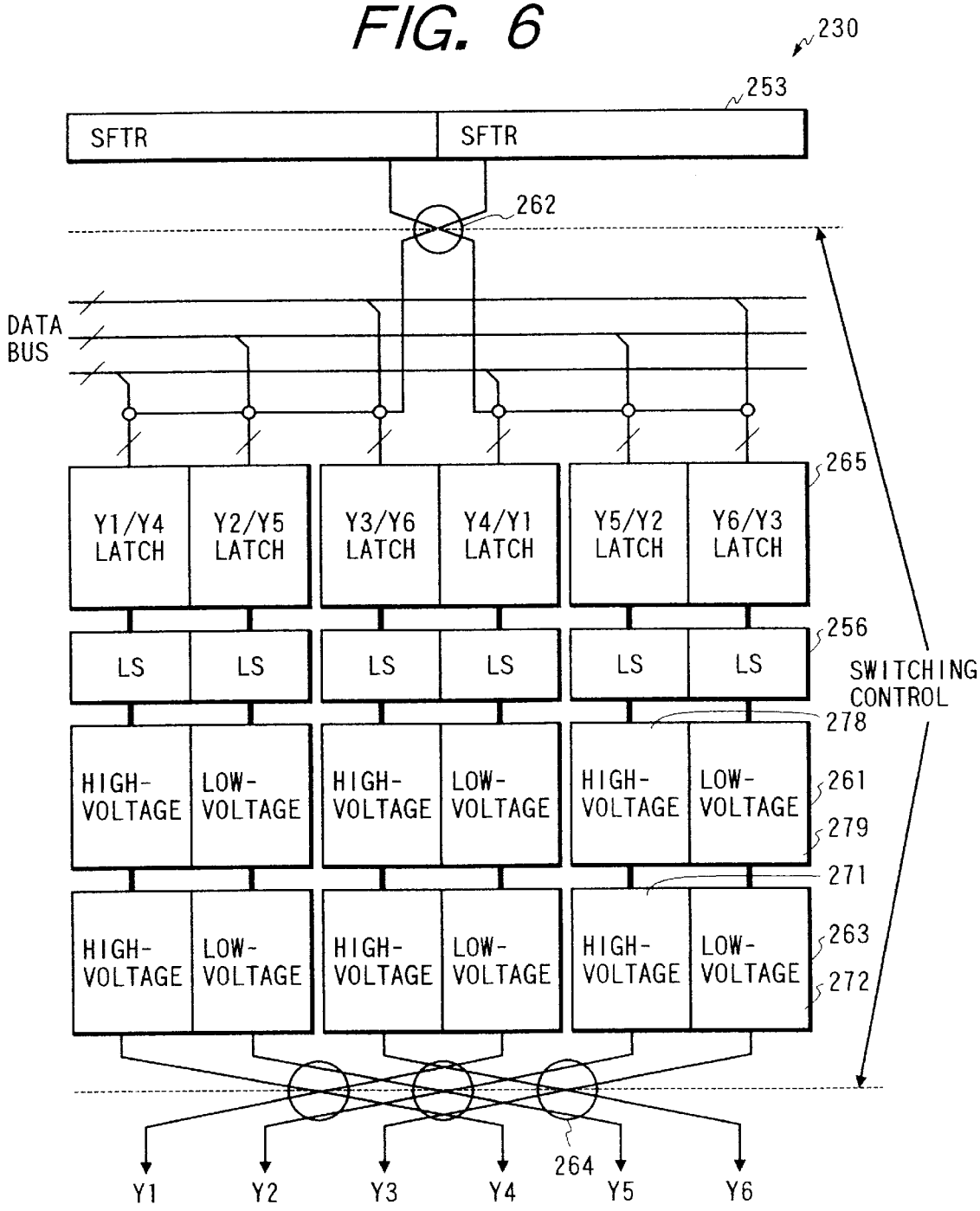
FIG. 6 is a block diagram explaining a configuration of a drain driver 230 in the second embodiment of the present invention centering upon a configuration of an output circuit 257.

FIG. 6 is a block diagram explaining a configuration of the drain driver 230 in the second embodiment of the present invention centering upon a configuration of the output circuit 257.

In FIG. 6, numeral 253 designates a shift register in the control circuit, numeral 256 designates a level shifter circuit (2), numeral 261 designates a decoder circuit (2), numeral 262 designates a switching circuit (3), numeral 263 designates an amplifier circuit pair, numeral 264 designates a switching circuit (2), and numeral 265 designates a data latch circuit.

The decoder circuit (2) 261 and the switching circuit (2) 264 for switching outputs of the amplifier circuit pair 263 constitute the output circuit 257, and the data latch circuit 265 comprises an input register 254 and a storage register 256.

Here, the switching circuit (3) 262 and the switching circuit (2) 264 are controlled based on the control signal (M) for AC driving.

Also, in the drain driver 230 of the second embodiment of the present invention, data input control signals to be inputted to the data latch circuit 265 (more specifically, input register 254 shown in FIG. 5) are inputted to alternately one of two adjacent groups of triads of data latch circuits 265 by the switching circuit (3) 262.

The decoder circuit (2) 261 is constituted by a high-voltage decoder circuit 278 for selecting a gray scale voltage corresponding to the display data outputted from each data latch circuit 265 (more specifically, storage register 255 shown in FIG. 5), among 64 levels of gray scale voltages of positive polarity outputted from the gray scale voltage generating circuit 251*a* through the voltage bus line 258*a*, and a low voltage decoder circuit 279 for selecting a gray scale voltage corresponding to the display data outputted from each data latch circuit 265, among 64 levels of gray scale voltages of negative polarity outputted from the gray scale voltage generating circuit 251*b* through the voltage bus line 258*b*.

A pair of the high voltage decoder circuit 278 and the low voltage decoder circuit 279 are provided for a pair of the two adjacent data latch circuits 265.

Here, since the voltage level of gray scale voltages of negative polarity to be inputted to the low voltage decoder circuit 279 is, for example, a voltage level of 0 to 4V, the low voltage decoder circuit 279 can be formedd by a low-voltage MOS transistor.

However, since the voltage level of gray scale voltages of positive polarity to be inputted to the high voltage decoder circuit 278 is, for example, a voltage level of 4 to 8V, the high voltage decoder circuit 278 is formed by a high-voltage MOS transistor. In the drain driver 230 in the second embodiment of the present invention, the voltage level of the display data is level-shifted to a high voltage, for example, to a voltage level of 4 to 8V, by the level shifter circuit (2) 256 connected to the high voltage decoder circuit 278.

In the drain driver 230 in the second embodiment of the present invention, the positive-polarity power source is used, but when the negative-polarity power source is used, the low-voltage decoder circuit 279 may be formed by a high voltage MOS transistor.

In the drain driver 230 of the second embodiment of the present invention, the following explains the case where all level shifter circuits (2) 256 shift the voltage level of the display data to a high voltage, and both the high-voltage decoder circuit 278 and the low-voltage decoder circuit 279 are formed by high-voltage MOS transistors.

The amplifier circuit pair 263 is constituted by a high voltage amplifier 271 and a low voltage amplifier 272.

Gray scale voltages of positive polarity selected by the high-voltage decoder circuit 278 are inputted to the high-voltage amplifier 271, and the high-voltage amplifier 271 outputs LC driving voltages of positive polarity.

Gray scale voltages of negative polarity selected by the low voltage decoder circuit 279 are inputted to the low-voltage amplifier 272, and the low-voltage amplifier 272 outputs LC driving voltages of negative polarity.

Figure 7:
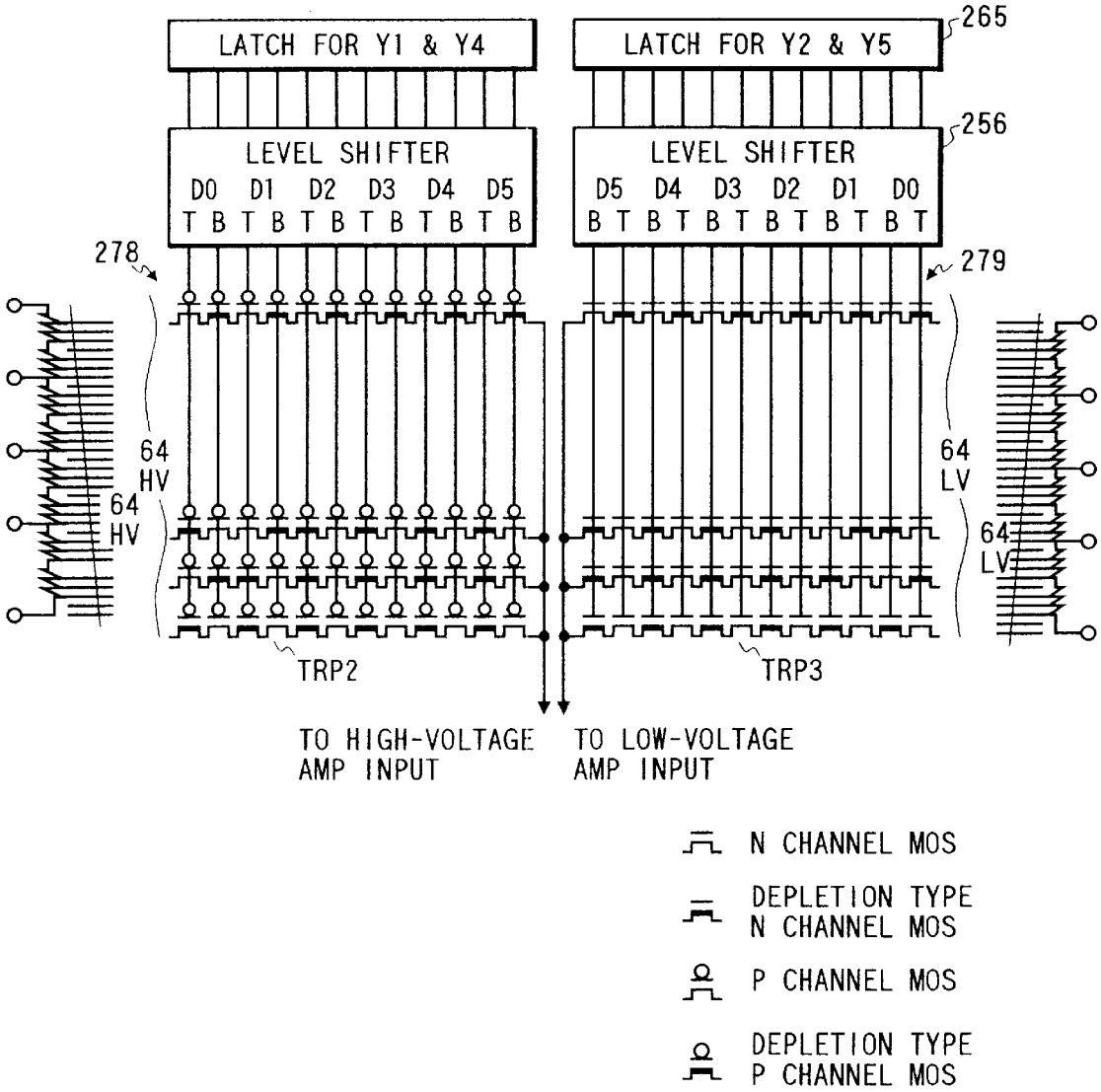
FIG. 7 is a circuit diagram showing a circuit configuration of a high-voltage decoder circuit 278 and a low-voltage decoder circuit 279 shown in FIG. 6.

FIG. 7 is a circuit diagram showing a circuit configuration of the high-voltage decoder circuit 278 and the low-voltage decoder circuit 279 shown in FIG. 6.

The high-voltage decoder circuit 278 has 64 transistor rows (TRP2) comprised of six high-voltage PMOS transistors connected in series with its output termial and six high-voltage depletion type PMOS transistors connected in series with its output terminal, and 64 levels of gray scale voltages of positive polarity outputted from the gray scale voltage generating circuit 251*a* through the voltage bus line 258*a* shown in FIG. 5 are inputted to a terminal opposite to the output terminal of each of the transistor rows (TRP2).

Noninverted outputs (T) of each bit or inverted outputs (B) of each bit of the display data of six bits outputted from the level shifter circuit (2) 256 are selectively applied based on a predetermined combination to respective gate electrodes of the six high-voltage PMOS transistors and the six high-voltage depletion type PMOS transistors constituting each of the transistor rows (TRP2).

The low-voltage decoder circuit 279 has 64 transistor rows (TRP3) comprised of six high-voltage NMOS transistors connected in series with its output terminal and six high-voltage depletion type NMOS transistors connected in series with its output terminal, and 64 levels of gray scale voltages of negative polarity outputted from the gray scale voltage generating circuit 251*b* through the voltage bus line 258*b* shown in FIG. 5 are inputted to a terminal opposite to the output terminal of each of the transistor rows (TRP3).

Noninverted outputs (T) of each bit or inverted outputs (B) of each bit of the display data of six bits outputted from the level shifter circuit (2) 256 are selectively applied based on a predetermined combination to respective gate electrodes of the six high-voltage NMOS transistors and the six high-voltage depletion type NMOS transistors constituting each of the transistor rows (TRP3).

In the high-voltage decoder circuit 278 and the low-voltage decoder circuit 279, six MOS transistors of the same polarity and six depletion type MOS transistors of the same polarity are connected in series based on a prescribed connection relationship on the same signal line, and among noninverted outputs (T) or inverted outputs (B) of each bit of the display data, noninverted outputs (T) or inverted outputs (B) of each non-selected bit are made conducting by the depletion type MOS transistor.

Since the high-voltage decoder circuit 278 and the low-voltage decoder circuit 279 are connected so that the six MOS transistors and the six depletion type MOS transistors of the same polarity, respectively, are connected in series on the same signal line, the six MOS transistors and the six depletion type MOS transistors of the same polarity constituting the high-voltage decoder circuit 278 and the low-voltage decoder circuit 279 may be provided with a high voltage structure only in gate electrode portions.

In the decoder circuit (2) 261 in the second embodiment of the present invention, since the high-voltage decoder circuit 278 and the low-voltage decoder circuit 279 are formed by high-voltage MOS transistors of the same polarity, a chip area of the semiconductor integrated circuit can be reduced in comparison with the case where the high-voltage decoder circuit 278 and the low-voltage decoder circuit 279 are formed by complementary MOS transistors including high-voltage PMOS and NMOS transistors.

Figure 8:
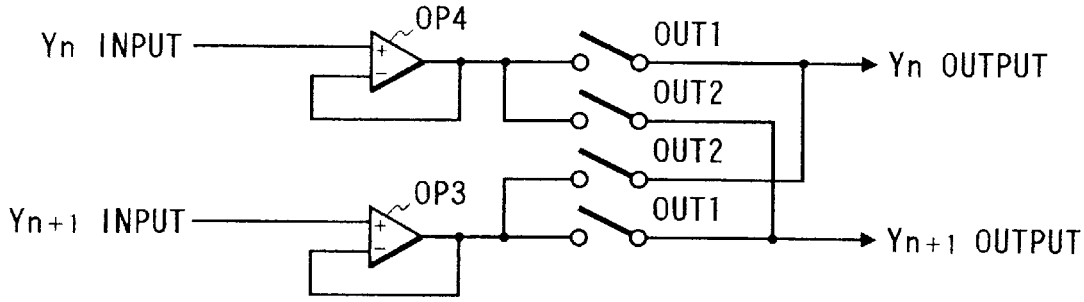
FIG. 8 is a circuit diagram showing a circuit configuration of an amplifier circuit pair 263 and a switching circuit (2) 264 shown in FIG. 6.

FIG. 8 is a circuit diagram showing a circuit configuration of the amplifier circuit pair 263 and the switching circuit (2) 264 shown in FIG. 6.

In FIG. 8, a switching circuit (OUT1, OUT2) indicates the switching circuit (2) 264. Here, the switching circuit (OUT1, OUT2) is constituted by high-voltage MOS transistors.

The low-voltage amplifier 272 constituting the amplifier circuit pair 263 is a voltage follower where an inverting terminal and an output terminal of an operational amplifier (OP3) are directly connected and a non-inverting terminal serves as an input terminal.

Also the high-voltage amplifier 271 constituting the amplifier circuit pair 263 is a voltage follower where an inverting terminal and an output terminal of an operational amplifier (OP4) are directly connected and a non-inverting terminal serves as an input terminal.

Since the high-voltage amplifier 271 outputs LC driving voltages of positive polarity to the video signal line (DL), a part or all of the MOS transistors constituting the high voltage amplifier 271 must be formed by high-voltage MOS transistors.

When output voltages outputted from the high-voltage-amplifier 271 or the low-voltage amplifier 272 are switched by the switching circuit (2) 264, since high-voltage may be applied to output of the low-voltage amplifier 272, a part or all of the MOS transistors constituting the low voltage amplifier 272 are preferably formed by high-voltage MOS transistors.

Figure 9:
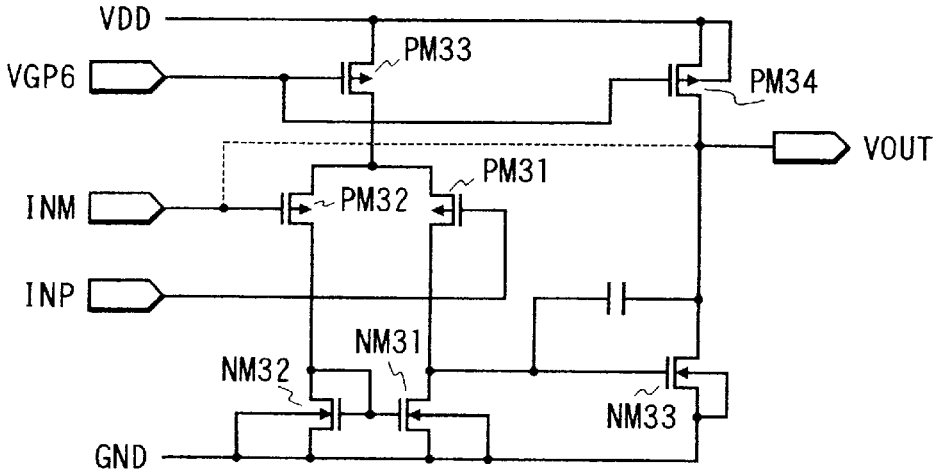
FIG. 9 is a circuit diagram showing an example of an operational amplifier (OP3) used in a low-voltage amplifier 272 forming an amplifier circuit pair 263.

FIG. 9 is a circuit diagram showing an example of an operational amplifier (OP3) to be used in the low-voltage amplifier 272 constituting the amplifier circuit pair 263.

The operational amplifier (OP3) shown in FIG. 9 is comprised of an input amplifier stage and a current amplifier stage. The input amplifier stage is constituted by a differential amplifier comprising a PMOS transistor (PM31) and a PMOS transistor (PM32), and an active load comprising a current mirror circuit constituted by NMOS transistor (NM31) and NMOS transistor (NM32) is connected to the differential amplifier.

The current amplifier stage is constituted by a series circuit of NMOS transistor (NM33) to whose gate electrode is applied the drain voltage of the PMOS transistor (PM31) and a constant-current source.

PMOS transistors (PM33, PM34) to whose gate electrode is applied the bias voltage, constitute a constant-current source, and VGP6 indicates a bias voltage source.

Here, each MOS transistor is a high-voltage MOS transistor.

As shown by a dotted line in FIG. 9, the inverting input terminal (INM) and the output terminal (VOUT) are directly connected to form a voltage follower.

Figure 10:
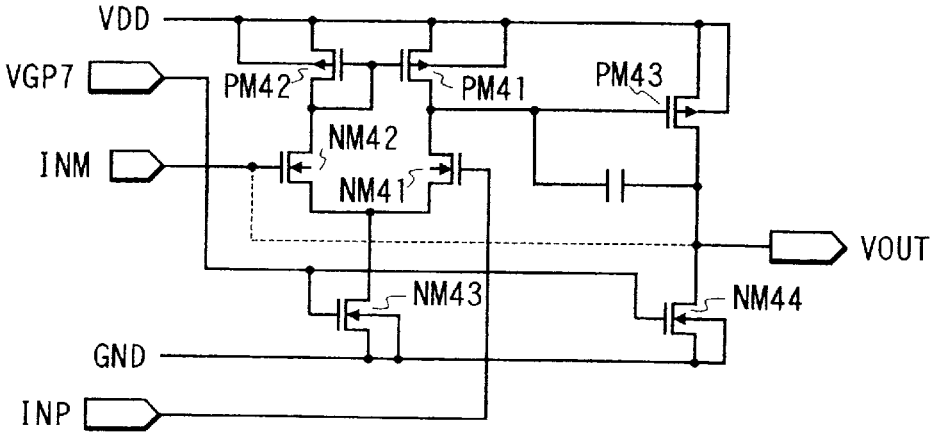
FIG. 10 is a circuit diagram showing an example of an operational amplifier (OP4) used in a high-voltage amplifier 271 forming an amplifier circuit pair 263.

FIG. 10 is a circuit diagram showing an example of an operational amplifier (OP4) to be used in the high-voltage amplifier 271 constituting the amplifier circuit pair 263.

The operational amplifier (OP4) shown in FIG. 10 is comprised of an input amplifier stage and a current amplifier stage. The input amplifier stage is constituted by a differential amplifier comprising an NMOS transistor (NM41) and an NMOS transistor (NM42), and an active load comprising a current mirror circuit constituted by a PMOS transistor (PM41) and a PMOS transistor (PM42) is connected to the differential amplifier.

The current amplifier stage is constituted by a series circuit of a PMOS transistor (PM43) to whose gate electrode is connected the drain voltage of the NMOS transistor (NM41) and a constant-current source.

NMOS transistors (NM43, NM44) to whose gate electrode is connected the bias voltage constitute a constant-current source, and VGP7 indicates a bias voltage source.

Here, each MOS transistor is constituted by a high-voltage MOS transistor.

As shown by a dotted line in FIG. 10, the inverting input terminal (INM) and the output terminal (VOUT) are directly connected to form a voltage follower.

In the drain driver 230 in the second embodiment of the present invention, the voltage follower can be used as an amplifier for outputting an LC driving voltage of positive polarity, and since the high-voltage inverting amplifier 571 need not be used, unlike in the drain driver 130 in the first embodiment of the present invention, the switching circuits (SW1–SW4) and a control circuit for controlling each of the switching circuits (SW1–SW4) are not necessary. As a result, a chip size of the semiconductor integrated circuit (IC chip) constituting the drain driver 230 can be made small. Since the voltage follower has a large input impedance, a current does not flow from the voltage bus lines (258*a*, 258*b*) into the voltage follower. Consequently the voltage level in the positive-polarity gray scale voltage generating circuit 251*a* or the negative-polarity gray scale voltage generating circuit 251*b* does not vary.

Also since the decoder circuit (2) 261 can be constituted by a unipolar high-voltage MOS transistor, an increase in a chip size of the semiconductor integrated circuit (IC chip) constituting the drain driver 230 can be minimized.

Further since the LC driving voltages applied to the pixel electrode (ITO1) are made different depending on its polarity, the image on the liquid crystal display panel (TFT-LCD) can be displayed with accurate multi-gray scale levels.

Embodiment 3

An active matrix type liquid crystal display module in a third embodiment of the present invention is different from the active matrix type liquid crystal display module in the second embodiment of the present invention in that a switching circuit (4) switches outputs of a level shifter circuit to be inputted to an amplifier circuit pair.

Also, in the active matrix type liquid crystal display module in the third embodiment of the present invention, a power supply circuit (220 shown in FIG. 4) in an interface circuit (200 shown in FIG. 4) is constituted by a positive-polarity voltage generating circuit (221 in FIG. 4) and a negative-polarity voltage generating circuit (222 shown in FIG. 4).

The positive-polarity voltage generating circuit and the negative-polarity voltage generating circuit are constituted by a voltage divider comprised of series resistors, and the positive-polarity voltage generating circuit outputs five gray scale reference voltages (V0–V4) of positive polarity and the negative-polarity voltage generating circuit outputs five gray scale reference voltages (V"5–V"9) of negative polarity.

A drain driver (330 shown in FIG. 11) in the third embodiment of the present invention has a positive-polarity gray scale voltage generating circuit (251*a* shown in FIG. 5) and a negative-polarity gray scale voltage generating circuit (251*b* shown in FIG. 5).

The positive-polarity gray scale voltage generating circuit generates 64 levels of gray scale voltages of positive polarity based on the five gray scale reference voltages (V0–V4) of positive polarity inputted from the positive-polarity voltage generating circuit (221 shown in FIG. 4), and outputs the gray scale voltages through a voltage bus line (258*a* shown in FIG. 5) to an output circuit (257 shown in FIG. 5).

The negative-polarity gray scale voltage generating circuit generates 64 levels of gray scale voltages of negative-polarity based on the five gray scale reference voltages (V"5–V"9) of negative polarity inputted from the negative-voltage generating circuit (222 shown in FIG. 4), and outputs the gray scale voltages through a voltage bus line (258*b* shown in FIG. 5) to the output circuit.

Figure 11:
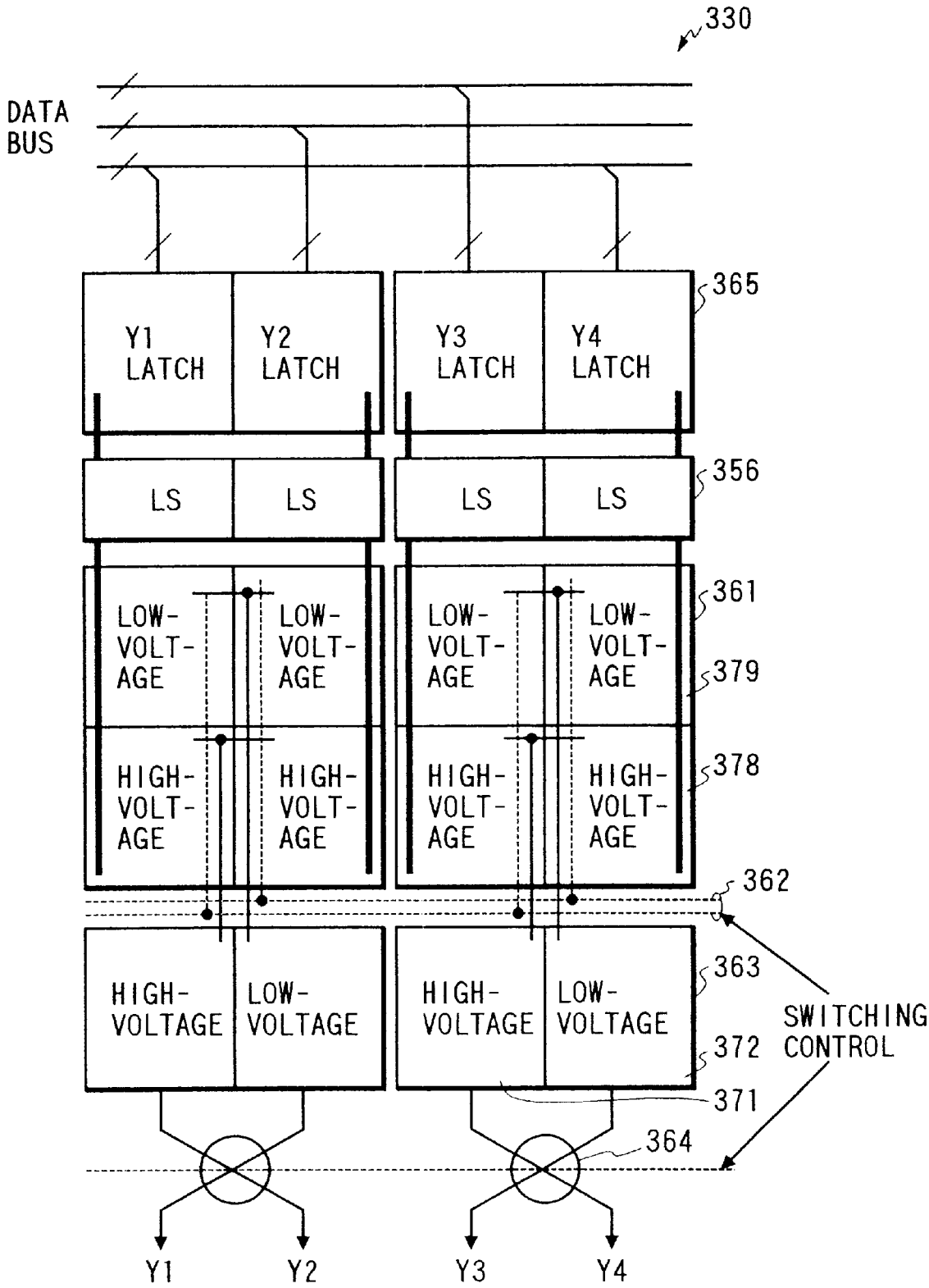
FIG. 11 is a block diagram explaining a configuration of a drain driver 330 in a third embodiment of the invention mainly centering upon a configuration of an output circuit.

FIG. 11 is a block diagram explaining a configuration of the drain driver 330 in the third embodiment of the present invention centering upon a configuration of the output circuit.

In FIG. 11, numeral 356 designates a level shifter circuit (2), numeral 361 designates a decoder circuit (3), numeral 362 designates a switching circuit (4), numeral 363 designates an amplifier circuit pair, numeral 364 designates a switching circuit (2), and numeral 365 designates a data latch circuit.

In FIG. 11, the decoder circuit (3) 361, the switching circuit (4) 362 for switching inputs to the amplifier circuit pair 363 and the switching circuit (2) 364 for switching outputs of the amplifier circuit pair 363 constitute the output circuit (257 shown in FIG. 5), and the data latch circuit 365 comprises an input register (254 shown in FIG. 5) and a storage register (255 shown in FIG. 5).

Here, the switching circuit (4) 362 and the switching circuit (2) 364 are controlled by the control signal (M) for AC driving.

In the drain driver 330 in the third embodiment of the present invention, gray scale voltages from the decoder circuit (3) 361 are supplied to the amplifier circuit pair 363 by the switching circuit (4) 362.

The decoder circuit (3) 361 is constituted by a high-voltage decoder circuit 378 for selecting a gray scale voltage corresponding to the display data outputted from each data latch circuit 365 (more specifically, storage register 255 shown in FIG. 5), among 64 levels of gray scale voltages of positive polarity outputted from a positive-polarity gray scale voltage generating circuit through a voltage bus line, and a low-voltage decoder circuit 379 for selecting a gray scale voltage corresponding to the display data outputted from each data latch circuit 365, among 64 levels of gray scale voltages of negative polarity outputted from a negative-polarity gray scale voltage generating circuit through a voltage bus line.

A pair of the high-voltage decoder circuit 378 and the low-voltage decoder circuit 379 are provided for each data latch circuit 365.

Since the voltage level of gray scale voltages of positive polarity to be inputted to the high-voltage decoder circuit 378 is, for example, a voltage level of 4–8V, the high-voltage decoder circuit 378 is constituted by high-voltage MOS transistors. Consequently the voltage level of the display data to be inputted to the high-voltage decoder circuit 378 is level-shifted to high voltages, for example, a voltage level of 4–8V, by the level shifter circuit (2) 356.

However, since each bit output from the level shifter circuit (2) 356 is inputted commonly to the high-voltage decoder circuit 378 and the low-voltage decoder circuit 379, in the drain driver 330 in the third embodiment of the present invention, the low-voltage decoder circuit 379 is also constituted by high-voltage MOS transistors.

The amplifier circuit pair 363 is constituted by a high-voltage amplifier 371 and a low-voltage amplifier 372.

The high-voltage amplifier 371 and the low-voltage amplifier 372 are constituted by a voltage follower as shown in FIG. 8.

Figure 12:
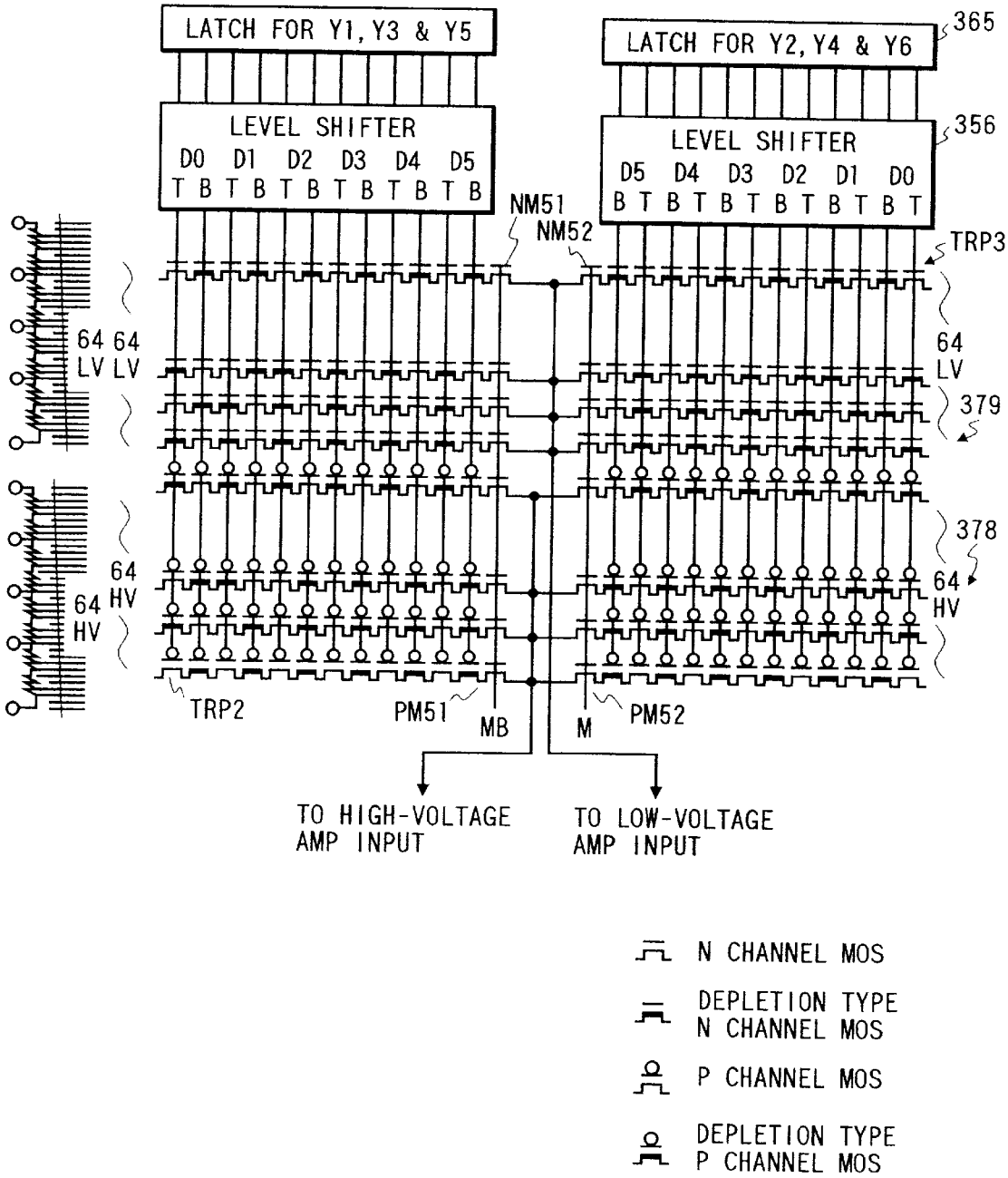
FIG. 12 is a circuit diagram of a switching circuit (4) 362 and a decoder circuit (3) 361 shown in FIG. 11.

FIG. 12 is a circuit diagram showing a circuit configuration of the switching circuit (4) 362 and the decoder circuit (3) 361 shown in FIG. 11.

The high-voltage decoder circuit 378 and the low-voltage decoder circuit 379 of the decoder circuit (3) 361 have the same circuit configuration as those of the high-voltage decoder circuit 278 and the low-voltage decoder circuit 279 shown in FIG. 7.

In the decoder circuit (3) 361 in the third embodiment of the present invention, however, the two adjacent high-voltage decoder circuits 378 are connected to each other by two high-voltage PMOS transistors (PM51, PM52) connected in series, and the joint of the two high-voltage PMOS transistors (PM51, PM52) serves as an output terminal for outputting gray scale voltages to the high-voltage amplifier 371.

Also the two adjacent low-voltage decoder circuits 379 are connected to each other by two high-voltage NMOS transistors (NM51, NM52), and the joint of the two high-voltage transistors (NM51, NM52) serves as an output terminal for outputting gray scale voltages to the low-voltage amplifier 372.

The two high-voltage PMOS transistors (PM51, PM52) and the two high-voltage NMOS transistors (NM51, NM52) constitute the switching circuit (4) 362, and an inverted signal (MB) of a control signal (M) for AC driving is inputted to gate electrodes of the high-voltage PMOS transistor (PM51) and the high-voltage NMOS transistor (NM51), and the control signal (M) for AC driving is inputted to gate electrodes of the high-voltage PMOS transistor (PM52) and the high-voltage NMOS transistor (NM52).

Consequently, in the drain driver 330 in the third embodiment of the present invention, one gray scale voltage selected by one on one side of the two adjacent high-voltage decoder circuits 378 and another gray scale voltage selected by one on the other side of the two adjacent low-voltage decoder circuits 379 are outputted at respective output terminals depending on whether the control signal (M) for AC driving is high or low.

Specifically, when the data latch circuits 365 for Y1, Y3, Y5, . . . select the low-voltage decoder circuits 379, the data latch circuits 365 for Y2, Y4, Y6, . . . select the high-voltage decoder 378.

The inverted control signal (MB) for AC driving applied to the gate electrodes of the high-voltage MOS transistors (PM51, NM51) and the control signal (M) for AC driving applied to the gate electrodes of the high-voltage MOS transistors (PM52, NM52) are level-shifted to a high voltage signal level.

In the drain driver 330 in the third embodiment of the present invention, a voltage follower can be used as an amplifier outputting an LC driving voltage of positive polarity, and since a high-voltage inverting amplifier 571 need not be used, unlike in the drain driver 130 in the first embodiment of the present invention the switching circuits (SW1–SW4) and a control circuit for controlling each of the switching circuits (SW1–SW4) are not necessary. Consequently, a chip size of the semiconductor integrated circuit (IC chip) constituting the drain driver 330 can be made small.

Since the voltage follower has a large input impedance, a current does not flow from the voltage bus line into the voltage follower, and the voltage level of multi-gray scale voltages generated in the positive-polarity gray scale voltage generating circuit or the negative-polarity gray scale voltage generating circuit does not vary.

Since the decoder circuit (4) 362 can be constituted by a unipolar high-voltage MOS transistor, an increase in a chip size of the semiconductor integrated circuit (IC chip) constituting the drain driver 330 can be minimized.

Since the LC driving voltages applied to the pixel electrode (ITO1) are made different depending upon its polarity, the image on the liquid crystal display panel (TFT-LCD) can be displayed with accurate multi-gray scale levels.

In the drain driver 330 in the third embodiment of the present invention, since the switching circuit (4) 362 is constituted by a unipolar MOS transistor, when the number of the video signal lines (DL) is 3n, the number (TM3) of MOS transistors constituting the switching circuit (4) 362 is 6n as indicated by the following formula (5).

$$TM3=4\times 3n/2=6n \tag{5}$$

As a result, in the drain driver 330 in the third embodiment of the present invention, the number of switching circuits constituting the switching circuit (4) 362 can be reduced to half of that of the drain driver 530 shown in FIG. 20.

Consequently, with the drain driver 330 in the third embodiment of the present invention, an increase in a chip size of the semiconductor integrated circuit (IC chip) constituting the drain driver 330 can be minimized, and the frame border area of the liquid crystal display panel (TFT-LCD) can be reduced.

In the above embodiments of the present invention, the present invention is applied to the vertical-electric field active matrix type liquid crystal display device, but it is clear that the invention is not limited to this, and can be also applied to the in-plane switching active matrix type liquid crystal display device.

Although the present invention has been described based on the specific embodiments, the invention is not limited to these specific embodiments, and it is clear that various changes and modifications may be made in the invention without departing from the spirit and scope thereof.

Advantages obtained by typical inventions disclosed in this specification will be summarized as follows:

(1) According to the present invention, since the number of switching circuits in a video signal line drive circuit can be significantly reduced, a chip size of a semiconductor integrated circuit (IC chip) constituting the video signal line drive circuit can be reduced and thereby the frame border area of the liquid crystal display panel can be reduced.

(2) According to the present invention, in the liquid crystal display device, since an inverting amplifier having a switched capacitor circuit need not be used as an amplifier for outputting an LC driving voltage of positive polarity or negative polarity, a chip size of a semiconductor integrated circuit (IC chip) constituting a video signal line drive circuit can be reduced.

(3) According to the present invention, in the liquid crystal display device, since a voltage follower can be used as an amplifier for outputting an LC driving voltage of positive polarity or negative polarity, variations in the voltage level of multi-gray scale voltages generated in a gray scale voltage generating circuit can be prevented.

(4) According to the present invention, in the liquid crystal display device, since a selector circuit for outputting a gray scale voltage of positive polarity or negative polarity can be constituted by unipolar high-voltage MOS transistors, an increase in a chip size of a semiconductor integrated circuit (IC chip) constituting a video signal line drive circuit can be minimized.

(5) According to the present invention, in the liquid crystal display device, since the LC driving voltages to be applied to a pixel electrode are made different depending upon their polarity, the image on the liquid crystal display panel can be displayed with accurate multi-gray scale levels.

(6) According to the present invention, in the liquid crystal display device, since the dot-inversion drive method can be employed, the voltage level of the common electrode is stable and deterioration of the display quality can be minimized.

What is claimed is:

1. A liquid crystal display device comprising a liquid crystal display panel including a plurality of video signal lines, a plurality of scanning signal lines perpendicular to the plurality of video signal lines, and a plurality of pixels arranged in a matrix and each surrounded by two adjacent video signal lines among the plurality of video signal lines and by two adjacent scanning signal lines among the plurality of scanning signal lines;

a video signal line drive circuit connected to each of the plurality of video signal lines which outputs LC driving voltages to each of the plurality of video signal lines to apply the LC driving voltages to each of the plurality of pixels; and a display control circuit which controls and drives the video signal line drive circuit;

wherein the video signal line drive circuit includes:

a first drive voltage circuit including at least one first output circuit each including a latch circuit which latches display data, and a decoder circuit which selects and outputs an LC driving voltage of positive polarity corresponding to the display data, and at least one second output circuit each including a latch circuit which latches display data, and a decoder circuit which selects and outputs an LC driving voltage of negative polarity corresponding to the display data, the at least one first output circuit and the at least one second output circuit being arranged alternately in a first polarity order;

a second drive voltage circuit including at least one third output circuit each including a latch circuit which latches display data, and a decoder circuit which selects and outputs an LC driving voltage of positive polarity corresponding to the display data, and at least one fourth output circuit each including a latch circuit which latches display data, and a decoder circuit which selects and outputs an LC driving voltage of negative polarity corresponding to the display data, the at least one third output circuit and the at least one fourth output circuit being arranged alternately in a second polarity order opposite to the first polarity order in which the at least one first output circuit and the at least one second output circuit of the first drive voltage circuit are arranged alternately;

a first switching circuit which inputs display data sequentially transferred from the display control circuit to the latch circuits of the first voltage drive circuit and the second voltage drive circuit in a first input order in which display data is sequentially inputted first to the latch circuits of the first drive voltage circuit and then to the latch circuits of the second drive voltage circuit, and a second input order in which display data is sequentially inputted first to the latch circuits of the second drive voltage circuit and then to the latch circuits of the first drive voltage circuit, the first switching circuit alternating the first input order and the second input order based on a display control signal from the display control circuit; and a second switching circuit which supplies outputs from the first drive voltage circuit and the second drive voltage circuit to each of the plurality of video signal lines in a first output arrangement corresponding to the first input order of the first switching circuit, and a second output arrangement corresponding to the second input order of the first switching circuit, the second switching circuit alternating the first output arrangement and the second output arrangement in synchronism with the alternation of the first input order and the second input order by the first switching circuit.

* * * * *